US012258691B2

(12) United States Patent
Quick

(10) Patent No.: US 12,258,691 B2
(45) **Date of Patent: *Mar. 25, 2025**

(54) BRAIDING MACHINE AND METHODS OF USE

(71) Applicant: Inceptus Medical, LLC, Aliso Viejo, CA (US)

(72) Inventor: Richard Quick, Mission Viejo, CA (US)

(73) Assignee: Inceptus Medical, LLC, Aliso Viejo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/401,954

(22) Filed: Jan. 2, 2024

(65) Prior Publication Data

US 2024/0344252 A1 Oct. 17, 2024

Related U.S. Application Data

(63) Continuation of application No. 17/732,305, filed on Apr. 28, 2022, now Pat. No. 11,898,282, which is a (Continued)

(51) Int. Cl.

| | |
|---|---|
| ***D04C 3/40*** | (2006.01) |
| ***D04C 3/44*** | (2006.01) |
| ***D04C 3/48*** | (2006.01) |

(52) U.S. Cl.

CPC ..... *D04C 3/40* (2013.01); *D04C 3/44* (2013.01); *D04C 3/48* (2013.01)

(58) Field of Classification Search

CPC ..... D04C 3/40; D04C 3/44; D04C 3/48

See application file for complete search history.

(56) References Cited

U.S. PATENT DOCUMENTS

| | | | | |
|---|---|---|---|---|
| 290,624 A | | 12/1883 | Barnes et al. | |
| 681,998 A | * | 9/1901 | Swift | D04C 3/38 87/18 |

(Continued)

FOREIGN PATENT DOCUMENTS

| | | |
|---|---|---|
| CN | 101687088 | 3/2010 |
| CN | 102119040 | 7/2011 |

(Continued)

OTHER PUBLICATIONS

International Search Report and Written Opinion for Application PCT/US12/43885. Date of Mailing Dec. 26, 2012, 14 pages.

(Continued)

*Primary Examiner* — Shaun R Hurley

(74) *Attorney, Agent, or Firm* — Perkins Coie LLP

(57) ABSTRACT

Systems and methods for forming a tubular braid are disclosed herein. A braiding system configured in accordance with embodiments of the present technology can include, for example, an upper drive unit, a lower drive unit, a mandrel coaxial with the upper and lower drive units, and a plurality of tubes extending between the upper drive unit and the lower drive unit. Each tube can be configured to receive individual filaments for forming the tubular braid, and the upper drive unit and the lower drive unit can act against the tubes in synchronization to cross the filaments over and under one another to form the tubular braid on the mandrel.

20 Claims, 13 Drawing Sheets

Related U.S. Application Data continuation of application No. 16/752,452, filed on Jan. 24, 2020, now Pat. No. 11,346,027, which is a continuation of application No. 15/990,499, filed on May 25, 2018, now Pat. No. 10,577,733, which is a continuation of application No. 15/784,122, filed on Oct. 14, 2017, now Pat. No. 9,994,980.

(60) Provisional application No. 62/508,938, filed on May 19, 2017, provisional application No. 62/408,604, filed on Oct. 14, 2016.

(56) References Cited

U.S. PATENT DOCUMENTS 787,383 A 4/1905 Klein
3,088,363 A 5/1963 Sparks
3,892,161 A 7/1975 Sokol
4,034,642 A 7/1977 Iannucci et al.
4,287,808 A 9/1981 Leonard et al.
4,312,261 A 1/1982 Florentine
4,535,674 A 8/1985 Bull et al.
4,719,837 A * 1/1988 McConnell ..... D04C 3/12 87/8
4,881,444 A * 11/1989 Krauland ..... D04C 3/34 87/8
4,885,973 A * 12/1989 Spain ..... D04C 3/12 87/8
4,916,997 A * 4/1990 Spain ..... C03C 14/002 87/8
5,301,596 A * 4/1994 Huey, Jr. ..... D04C 3/18 87/8
5,702,421 A 12/1997 Schneidt
5,725,552 A 3/1998 Kotula et al.
5,733,294 A 3/1998 Forber et al.
5,741,332 A 4/1998 Schmitt
5,749,858 A 5/1998 Cramer
5,800,525 A 9/1998 Bachinski et al.
5,827,304 A 10/1998 Hart
5,861,003 A 1/1999 Latson et al.
5,944,738 A 8/1999 Amplatz et al.
5,974,938 A 11/1999 Lloyd
5,976,174 A 11/1999 Ruin
6,254,571 B1 7/2001 Hart
6,331,184 B1 12/2001 Abrams
6,346,117 B1 2/2002 Greenhalgh
6,375,668 B1 4/2002 Gifford et al.
6,458,139 B1 10/2002 Parmer et al.
6,468,303 B1 10/2002 Amplatz et al.
6,495,227 B1 12/2002 Cahnzae
6,511,492 B1 1/2003 Rosenbluth et al.
6,554,849 B1 4/2003 Jones et al.
6,635,068 B1 10/2003 Dubrul et al.
6,893,458 B2 5/2005 Cox et al.
6,932,830 B2 8/2005 Ungs
6,994,092 B2 2/2006 Van Der Burg et al.
7,048,014 B2 5/2006 Hyodoh et al.
7,069,835 B2 7/2006 Nishri et al.
7,128,073 B1 10/2006 Van Der Burg et al.
7,313,505 B2 12/2007 Brown
7,500,345 B2 * 3/2009 Kish ..... D07B 7/02 87/34
7,727,189 B2 6/2010 Vantassel et al.
7,922,732 B2 4/2011 Mazzocchi et al.
8,034,061 B2 10/2011 Amplatz et al.
8,246,641 B2 8/2012 Osborne et al.
8,361,138 B2 1/2013 Adams
8,398,670 B2 3/2013 Amplatz et al.
8,430,012 B1 4/2013 Marchand et al.
8,454,633 B2 6/2013 Amplatz et al.
8,534,176 B2 * 9/2013 Giszter ..... D04C 3/42 87/55
8,641,777 B2 2/2014 Strauss et al.
8,690,907 B1 4/2014 Janardhan et al.
8,715,316 B1 5/2014 Janardhan et al.
8,747,432 B1 6/2014 Janardhan et al.
8,758,389 B2 6/2014 Glimsdale
8,764,787 B2 7/2014 Ren
8,820,207 B2 9/2014 Marchand et al.
8,821,529 B2 9/2014 Kariniemi et al.
8,826,791 B2 * 9/2014 Thompson ..... D04C 3/40 87/34
8,833,224 B2 * 9/2014 Thompson ..... D04C 3/40 87/34
8,852,205 B2 10/2014 Brady et al.
8,961,556 B2 2/2015 Amplatz et al.
9,039,724 B2 5/2015 Amplatz et al.
9,078,658 B2 7/2015 Hewitt et al.
9,179,899 B2 11/2015 Freudenthal
9,179,920 B2 11/2015 Ren
9,259,237 B2 2/2016 Quick et al.
9,528,205 B2 * 12/2016 Thompson ..... D04C 3/40
9,681,876 B2 6/2017 Cragg et al.
9,743,918 B2 8/2017 Amplatz et al.
9,765,457 B2 * 9/2017 Tahara ..... D04C 3/18
9,770,232 B2 9/2017 Amin et al.
9,844,382 B2 12/2017 Aboytes et al.
9,861,346 B2 1/2018 Callaghan
9,861,467 B2 1/2018 Cully et al.
9,913,652 B2 3/2018 Bridgeman et al.
9,994,980 B2 * 6/2018 Quick ..... D04C 1/06
10,376,267 B2 8/2019 Lubock et al.
10,577,733 B2 * 3/2020 Quick ..... D04C 3/48
11,304,701 B2 4/2022 Lubock et al.
11,346,027 B2 5/2022 Quick
11,885,051 B2 * 1/2024 Quick ..... D04C 3/06
11,898,282 B2 * 2/2024 Quick ..... D04C 3/44
2002/0072765 A1 6/2002 Mazzocchi et al.
2002/0123802 A1 11/2002 Snyders
2002/0165572 A1 11/2002 Saadat
2003/0139802 A1 7/2003 Wulfman et al.
2003/0181942 A1 9/2003 Sutton et al.
2003/0187473 A1 10/2003 Berenstein et al.
2003/0204249 A1 10/2003 Letort
2004/0073243 A1 4/2004 Sepetka et al.
2004/0176798 A1 9/2004 Epstein et al.
2004/0215167 A1 10/2004 Belson
2004/0215230 A1 10/2004 Frazier et al.
2004/0254633 A1 12/2004 Rapaport et al.
2005/0039769 A1 2/2005 Bousfield et al.
2005/0113861 A1 5/2005 Corcoran et al.
2005/0119668 A1 6/2005 Teague et al.
2005/0119682 A1 6/2005 Nguyen et al.
2005/0137692 A1 6/2005 Haug et al.
2005/0228434 A1 10/2005 Amplatz et al.
2005/0267493 A1 12/2005 Schreck et al.
2006/0079930 A1 4/2006 McGuckin et al.
2006/0129222 A1 6/2006 Stinson
2006/0247680 A1 11/2006 Amplatz et al.
2006/0265054 A1 11/2006 Greenhalgh et al.
2006/0293706 A1 12/2006 Shimon
2007/0005103 A1 1/2007 Schaeffer
2007/0027534 A1 2/2007 Bergheim et al.
2007/0093744 A1 4/2007 Elmaleh
2007/0106311 A1 5/2007 Wallace et al.
2007/0118165 A1 5/2007 DeMello et al.
2007/0129791 A1 6/2007 Balaji
2007/0161963 A1 7/2007 Smalling
2007/0185500 A1 8/2007 Martin et al.
2007/0208376 A1 9/2007 Meng
2007/0208412 A1 9/2007 Elmaleh
2008/0140110 A1 6/2008 Spence
2008/0200945 A1 8/2008 Amplatz et al.
2008/0262472 A1 10/2008 Lunn et al.
2009/0062841 A1 3/2009 Amplatz et al.
2009/0082803 A1 3/2009 Adams et al.
2009/0112251 A1 4/2009 Qian et al.
2009/0112309 A1 4/2009 Jaramillo et al.
2009/0099647 A1 6/2009 Glimsdale et al.
2009/0254172 A1 10/2009 Grewe
2009/0222076 A1 11/2009 Figulla et al.
2009/0275974 A1 11/2009 Marchand et al.
2010/0023048 A1 1/2010 Mach
2010/0030244 A1 2/2010 Woolfson et al.

(56) References Cited

U.S. PATENT DOCUMENTS

| | | | | |
|---|---|---|---|---|
| 2010/0036474 | A1 | 2/2010 | Bergheim | |
| 2010/0076482 | A1 | 3/2010 | Shu et al. | |
| 2010/0114152 | A1 | 5/2010 | Shukla | |
| 2010/0168785 | A1 | 7/2010 | Parker | |
| 2010/0211046 | A1 | 8/2010 | Adams et al. | |
| 2010/0256723 | A1 | 10/2010 | Murray | |
| 2010/0305604 | A1 | 12/2010 | Pah | |
| 2010/0324588 | A1 | 12/2010 | Miles et al. | |
| 2011/0146361 | A1 | 6/2011 | Davidson et al. | |
| 2011/0152993 | A1 | 6/2011 | Marchand et al. | |
| 2011/0160742 | A1 | 6/2011 | Ferrera et al. | |
| 2011/0208234 | A1 | 8/2011 | Mazzocchi et al. | |
| 2011/0277618 | A1* | 11/2011 | Giszter | D04C 3/42 87/8 |
| 2011/0301630 | A1 | 12/2011 | Hendriksen et al. | |
| 2012/0022639 | A1 | 1/2012 | Hacohen et al. | |
| 2012/0006187 | A1 | 6/2012 | Emmerich | |
| 2012/0143242 | A1 | 6/2012 | Masters | |
| 2012/0283768 | A1 | 11/2012 | Cox et al. | |
| 2012/0323267 | A1 | 12/2012 | Ren | |
| 2012/0330347 | A1 | 12/2012 | Becking et al. | |
| 2013/0060323 | A1 | 3/2013 | McHugo | |
| 2013/0092012 | A1 | 4/2013 | Marchand et al. | |
| 2013/0092013 | A1* | 4/2013 | Thompson | D04C 3/42 87/9 |
| 2013/0096606 | A1 | 4/2013 | Bruchman et al. | |
| 2013/0110153 | A1 | 5/2013 | Wang et al. | |
| 2013/0226223 | A1 | 8/2013 | Spenser | |
| 2013/0239790 | A1* | 9/2013 | Thompson | D04C 3/48 87/9 |
| 2013/0282054 | A1 | 10/2013 | Osypka | |
| 2014/0005713 | A1 | 1/2014 | Bowman | |
| 2014/0005714 | A1 | 1/2014 | Quick et al. | |
| 2014/0052170 | A1 | 2/2014 | Heuser et al. | |
| 2014/0107694 | A1 | 4/2014 | Wang | |
| 2014/0135810 | A1 | 5/2014 | Divino et al. | |
| 2014/0303667 | A1 | 10/2014 | Cox et al. | |
| 2014/0303719 | A1 | 10/2014 | Cox et al. | |
| 2014/0318354 | A1* | 10/2014 | Thompson | D04C 1/12 87/9 |
| 2014/0318355 | A1 | 10/2014 | Marchand et al. | |
| 2014/0324091 | A1 | 10/2014 | Rosenbluth et al. | |
| 2014/0330299 | A1 | 11/2014 | Rosenbluth et al. | |
| 2014/0330305 | A1 | 11/2014 | Rood et al. | |
| 2014/0343602 | A1 | 11/2014 | Cox et al. | |
| 2014/0364897 | A1 | 12/2014 | Myla | |
| 2015/0005811 | A1 | 1/2015 | Lubock et al. | |
| 2015/0032148 | A1 | 1/2015 | Golan | |
| 2015/0039016 | A1 | 2/2015 | Naor et al. | |
| 2015/0039017 | A1 | 2/2015 | Cragg et al. | |
| 2015/0133989 | A1 | 5/2015 | Lubock et al. | |
| 2015/0196301 | A1 | 7/2015 | Bodewadt et al. | |
| 2015/0223829 | A1 | 8/2015 | Aboytes | |
| 2015/0257763 | A1 | 9/2015 | Blum et al. | |
| 2015/0275408 | A1* | 10/2015 | Tahara | D04C 3/28 87/9 |
| 2015/0374391 | A1 | 12/2015 | Quick et al. | |
| 2016/0015398 | A1 | 1/2016 | Hewitt et al. | |
| 2016/0022270 | A1 | 1/2016 | Watson et al. | |
| 2016/0045211 | A1 | 2/2016 | Janardhan et al. | |
| 2016/0128822 | A1 | 5/2016 | Tejani | |
| 2016/0151141 | A1 | 6/2016 | Zimmerman | |
| 2016/0206321 | A1 | 7/2016 | Connor | |
| 2017/0007260 | A1 | 1/2017 | O'Brien et al. | |
| 2017/0014114 | A1 | 1/2017 | Rafiee et al. | |
| 2017/0014115 | A1 | 1/2017 | Rafiee et al. | |
| 2017/0037548 | A1 | 2/2017 | Lee | |
| 2017/0088988 | A1* | 3/2017 | Thompson | D04C 3/40 |
| 2017/0119400 | A1 | 5/2017 | Amplatz et al. | |
| 2017/0224355 | A1 | 8/2017 | Bowman et al. | |
| 2017/0233908 | A1 | 8/2017 | Kroczynski et al. | |
| 2018/0028312 | A1 | 2/2018 | Thill et al. | |
| 2018/0105963 | A1* | 4/2018 | Quick | D04C 3/48 |
| 2018/0242980 | A1 | 8/2018 | Lubock et al. | |
| 2018/0274141 | A1 | 9/2018 | Quick | |
| 2019/0307464 | A1 | 10/2019 | Lubock et al. | |
| 2020/0240056 | A1 | 7/2020 | Quick et al. | |
| 2020/0261098 | A1 | 8/2020 | Lubock et al. | |
| 2020/0270784 | A1 | 8/2020 | Quick | |
| 2022/0031335 | A1 | 2/2022 | Lubock et al. | |
| 2022/0251744 | A1 | 8/2022 | Quick | |
| 2024/0344251 | A1 | 10/2024 | Quick et al. | |
| 2024/0344252 | A1 | 10/2024 | Quick | |

FOREIGN PATENT DOCUMENTS

| | | | |
|---|---|---|---|
| CN | 102362023 | A | 2/2012 |
| CN | 103874794 | A | 6/2014 |
| CN | 103911744 | | 7/2014 |
| CN | 103975101 | A | 8/2014 |
| CN | 106436007 | A | 2/2017 |
| CN | 110100052 | A | 8/2019 |
| DE | 202008001829 | | 7/2008 |
| DE | 102007056946 | | 5/2009 |
| EP | 1849440 | | 7/2011 |
| EP | 2932921 | | 10/2015 |
| GB | 231065 | | 3/1925 |
| JP | 2014532127 | | 12/2014 |
| WO | WO9601591 | | 1/1996 |
| WO | WO9916382 | | 4/1999 |
| WO | WO0027292 | | 5/2000 |
| WO | WO0043062 | | 7/2000 |
| WO | WO2006074032 | | 7/2006 |
| WO | WO2006128193 | | 11/2006 |
| WO | WO2008066881 | | 6/2008 |
| WO | WO2008150346 | | 12/2008 |
| WO | WO2009014528 | | 1/2009 |
| WO | WO2010006061 | | 1/2010 |
| WO | WO2011027002 | | 3/2011 |
| WO | WO2011057002 | | 5/2011 |
| WO | WO2011057087 | | 5/2011 |
| WO | WO2013028579 | | 2/2013 |
| WO | WO2013074486 | | 5/2013 |
| WO | WO2013104721 | | 7/2013 |
| WO | WO2016045987 | | 3/2016 |
| WO | WO2018071880 | | 4/2018 |
| WO | WO2018156962 | | 8/2018 |
| WO | WO2019075444 | | 4/2019 |

OTHER PUBLICATIONS

International Search Report and Written Opinion for Application PCT/US12/51502. Date of Mailing Oct. 25, 2012, 11 pages.

International Search Report and Written Opinion for Application PCT/US12/67479. Date of Mailing Feb. 25, 2013, 12 pages.

International Search Report and Written Opinion for Application PCT/US13/20381. Date of Mailing Apr. 8, 2013, 13 pages.

International Search Report and Written Opinion for Application PCT/US13/37484. Date of Mailing Sep. 12, 2013, 12 pages.

International Search Report and Written Opinion for International Application No. PCT/US2014/029210, mailed Aug. 12, 2014, 15 pages.

Schmitz-Rode et al., "Temporary Pulmonary Stent Placement as Emergency Treatment of Pulmonary Embolism," Journal of the American College of Cardiology, vol. 48, No. 4, 2006 (5 pgs.).

Turk et al., "ADAPT FAST study: a direct aspiration first pass technique for acute stroke thrombectomy." J NeuroIntervent Surg, vol. 6, 2014, 6 pages.

Lewin, "Medical Device Innovation in America: Tensions Between Food and Drug Law and Patent Law," Harvard Journal of Law and Technology, vol. 26, No. 1, Fall 2012, 25 pages.

International Search Report and Written Opinion for PCT Application No. PCT/US17/56692, Applicant: Inceptus Medical, LLC, Date of Mailing: Jan. 25, 2018, 16 pages.

Ross et al, "The Vascular Plug: A New Device for Parent Artery Occlusion," American Journal of Neuroradiology, Feb. 2007, pp. 385-386.

Gandhi et al., "The MVP Micro Vascular Plug: A new Paradigm in Peripheral Embolization," Insert to Endovascular Today, Apr. 2015, pp. 80-84.

(56) References Cited

OTHER PUBLICATIONS

International Search Report for International Application No. PCT/US2018/019532, filed Feb. 23, 2018; Applicant: Inceptus Medical, LLC; Date of Mailing: Jun. 27, 2018, 5 pages.
Written Opinion for International Application No. PCT/US2018/019532, filed Feb. 23, 2018; Applicant: Inceptus Medical, LLC; Date of Mailing: Jun. 27, 2018, 8 pages.
Barwad et al, "Amplatzer Vascular Plugs in Congenital Cardiovascular Malformations," Annals of Pediatric Cardiology 2013, vol. 6, Issue 2, Date of Web Publication: Jul. 20, 2013, 9 pages.
Sharafuddin et al, "Experimental Comparison with Standard Gianturco Coils," From the Department of Radiology, University of Minnesota Hospital and Clinic, 420 Delaware St, SE, Minneapolis, MN 55455; from the 1996 SCVIR annual meeting. Received Apr. 30, 1996; revision requested June 6; revision received and accepted Jun. 19, 1996, 9 pages.
International Search Report and Written Opinion for International Application No. PCT/US2018/055780, filed Oct. 13, 2018; Applicant: Inceptus Medical, LLC; Date of Mailing: Jan. 22, 2019, 8 pages.
Extended European Search Report received for EP Application No. 17860912.9, Applicant: Inceptus Medical, LLC, Date of Mailing: May 15, 2020, 7 pages.
European Search Report received for EP Application No. 18758008.9, Applicant: Inceptus Medical, LLC, Date of Mailing: Aug. 17, 2020, 13 pages.

* cited by examiner

BRAIDING MACHINE AND METHODS OF USE

CROSS-REFERENCE TO RELATED APPLICATIONS

This application is a continuation of U.S. patent application Ser. No. 17/732,305, filed Apr. 28, 2022, and titled "BRAIDING MACHINE AND METHODS OF USE," now issued as U.S. Pat. No. 11,898,282, which is a continuation of U.S. patent application Ser. No. 16/752,452, filed Jan. 24, 2020, and titled "BRAIDING MACHINE AND METHODS OF USE," now issued as U.S. Pat. No. 11,346,027, which is a continuation of U.S. patent application Ser. No. 15/990,499, filed May 25, 2018, now issued as U.S. Pat. No. 10,577,733, and titled "BRAIDING MACHINE AND METHODS OF USE," which is a continuation of U.S. patent application Ser. No. 15/784,122, filed Oct. 14, 2017, and titled "BRAIDING MACHINE AND METHODS OF USE," now issued as U.S. Pat. No. 9,994,980, which claims priority to U.S. Provisional Application No. 62/408,604, filed Oct. 14, 2016, and titled "BRAIDING MACHINE AND METHODS OF USE," and U.S. Provisional Application No. 62/508,938, filed May 19, 2017, and titled "BRAIDING MACHINE AND METHODS OF USE," each of which is incorporated herein by reference in its entirety.

TECHNICAL FIELD

The present technology relates generally to systems and methods for forming a tubular braid of filaments. In particular, some embodiments of the present technology relate to systems for forming a braid through the movement of vertical tubes, each housing a filament, in a series of discrete radial and arcuate paths around a longitudinal axis of a mandrel.

BACKGROUND

Braids generally comprise many filaments interwoven together to form a cylindrical or otherwise tubular structure. Such braids have a wide array of medical applications. For example, braids can be designed to collapse into small catheters for deployment in minimally invasive surgical procedures. Once deployed from a catheter, some braids can expand within the vessel or other bodily lumen in which they are deployed to, for example, occlude or slow the flow of bodily fluids, to trap or filter particles within a bodily fluid, or to retrieve blood clots or other foreign objects in the body.

Some known machines for forming braids operate by moving spools of wire such that the wires paid out from individual spools cross over/under one another. However, these braiding machines are not suitable for most medical applications that require braids constructed of very fine wires that have a low tensile strength. In particular, as the wires are paid out from the spools they can be subject to large impulse forces that may break the wires. Other known braiding machines secure a weight to each wire to tension the wires without subjecting them to large impulse forces during the braiding process. These machines then manipulate the wires using hooks other means for gripping the wires to braid the wires over/under each other. One drawback with such braiding machines is that they tend to be very slow. Moreover, since braids have many applications, the specifications of their design-such as their length, diameter, pore size, etc., can vary greatly. Accordingly, it would be desirable to provide a braiding machine capable of forming braids with varying dimensions, using very thin filaments, and at higher speeds that hook-type over/under braiders.

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present disclosure.

DETAILED DESCRIPTION

The present technology is generally directed to systems and methods for forming a braided structure from a plurality of filaments. In several embodiments, a braiding system according to present technology can include an upper drive unit, a lower drive unit coaxially aligned with the upper drive unit along a central axis, and a plurality of tubes extending between the upper and lower drive units and constrained within the upper and lower drive units. Each tube can receive the end of an individual filament attached to a weight. The filaments can extend from the tubes to a mandrel aligned with the central axis. In certain embodiments, the upper and lower drive units can act in synchronization to move a subset of the tubes (i) radially inward toward the central axis, (ii) radially outward from the central axis, (iii) and rotationally about the central axis. Accordingly, the upper and lower drive units can operate to move the subset of tubes—and the filaments held therein-past another subset of tubes to form, for example, an "over/under" braided structure on the mandrel. Because the wires are contained within the tubes and the upper and lower drive units act in synchronization upon both the upper and lower portion of the tubes, the tubes can be rapidly moved past each other to form the braid. This is a significant improvement over systems that do not move both the upper and lower portions of the tubes in synchronization. Moreover, the present systems permit for very fine filaments to be used to form the braid since tension is provided using a plurality of weights. The filaments are therefore not subject to large impulse forces during the braiding process that may break them.

As used herein, the terms "vertical," "lateral," "upper," and "lower" can refer to relative directions or positions of features in the braiding systems in view of the orientation shown in the Figures. For example, "upper" or "uppermost" can refer to a feature positioned closer to the top of a page than another feature. These terms, however, should be construed broadly to include semiconductor devices having other orientations, such as inverted or inclined orientations where top/bottom, over/under, above/below, up/down, and left/right can be interchanged depending on the orientation.

Figure 1:
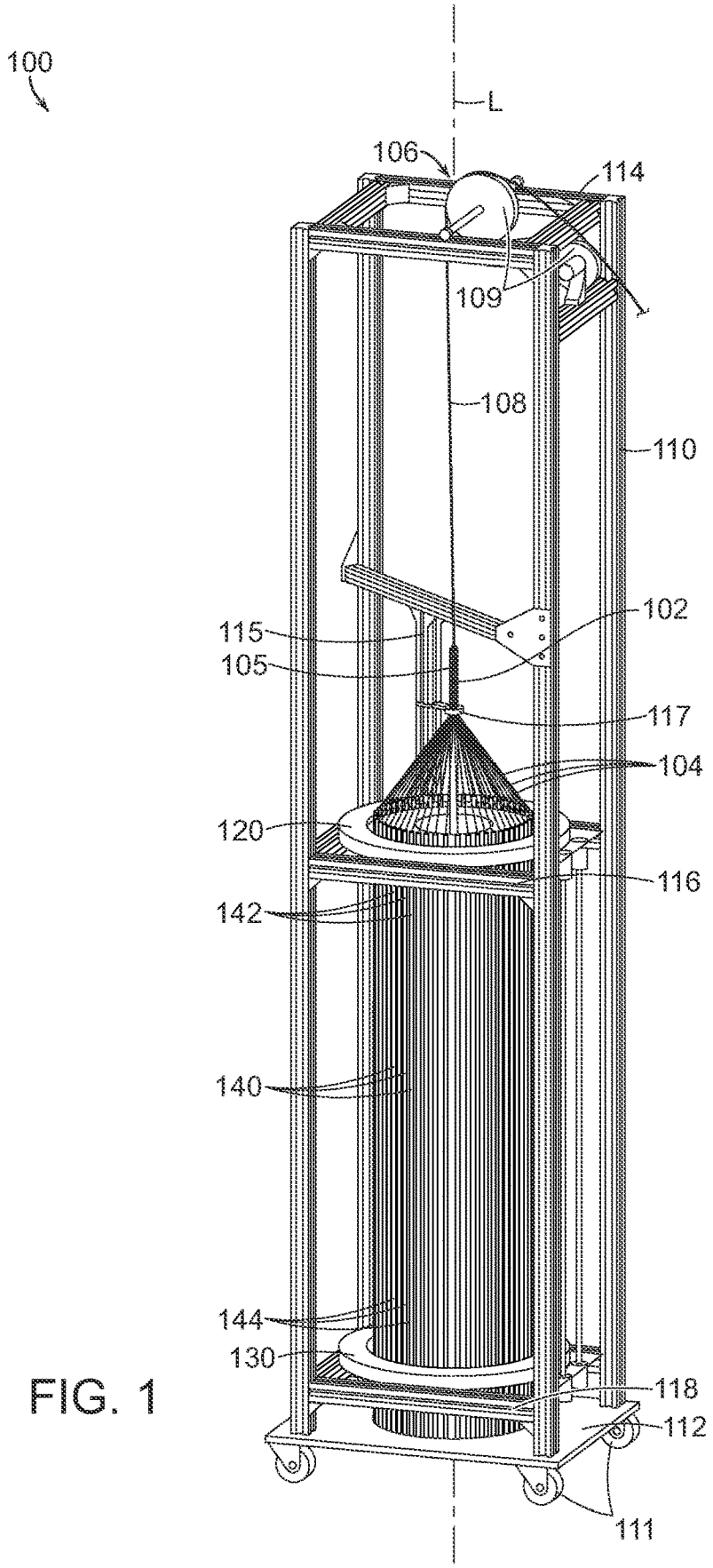
FIG. 1 is an isometric view of a braiding system configured in accordance with embodiments of the present technology.

FIG. 1 is an isometric of a braiding system 100 ("system 100") configured in accordance with the present technology. The system 100 includes a frame 110, an upper drive unit 120 coupled to the frame 110, a lower drive unit 130 coupled to the frame 110, a plurality of tubes 140 (e.g., elongate housings) extending between the upper and lower drive units 120, 130 (collectively "drive units 120, 130"), and a mandrel 102. In some embodiments, the drive units 120, 130 and the mandrel 102 are coaxially aligned along a central axis L (e.g., a longitudinal axis). In the embodiment illustrated in FIG. 1, the tubes 140 are arranged symmetrically with respect to the central axis L with their longitudinal axes parallel to the central axis L. As shown, the tubes 140 are arranged in a circular array about the central axis L. That is, the tubes 140 can each be spaced equally radially from the central axis L, and can collectively form a cylindrical shape. In other embodiments, the longitudinal axes of the tubes 140 may not be vertically aligned with (e.g., parallel to) the central axis L. For example, the tubes 140 can be arranged in a conical shape such that the longitudinal axes of the tubes 140 are angled with respect to and intersect the central axis L. In yet other embodiments, the tubes 140 can be arranged in a "twisted" shape in which the longitudinal axes of the tubes 140 are angled with respect to the central axis L, but do not intersect the central axis L (e.g., the top ends of the tubes can be angularly offset from the bottom ends of the tubes with respect the central axis L).

The frame 110 can generally comprise a metal (e.g., steel, aluminum, etc.) structure for supporting and housing the components of the system 100. More particularly, for example, the frame 110 can include an upper support structure 116 that supports the upper drive unit 120, a lower support structure 118 that supports the lower drive unit 130, a base 112, and a top 114. In some embodiments, the drive units 120, 130 are directly attached (e.g., via bolts, screws, etc.) to the upper and lower support structures 116, 118, respectively. In some embodiments, the base 112 can be configured to support all or a portion of the tubes 140. In the embodiment illustrated in FIG. 1, the system 100 includes wheels 111 coupled to the base 112 of the frame 110 and can, accordingly, be a portable system. In other embodiments, the base 112 can be permanently attached to a surface (e.g., a floor) such that the system 100 is not portable.

The system 100 operates to braid filaments 104 loaded to extend radially from the mandrel 102 to the tubes 140. As shown, each tube 140 can receive a single filament 104 therein. In other embodiments, only a subset of the tubes 140 receive a filament. In some embodiments, the total number of filaments 104 is one half the total number of tubes 140 that house the filament 104*s*. That is, the same filament 104 can have two ends, and two different tubes 140 can receive the different ends of the same filament 104 (e.g., after the filament 104 has been wrapped around or otherwise secured to the mandrel 102). In other embodiments, the total number of filaments 104 is the same as the number of tubes 140 that house a filament 104.

Figure 2:
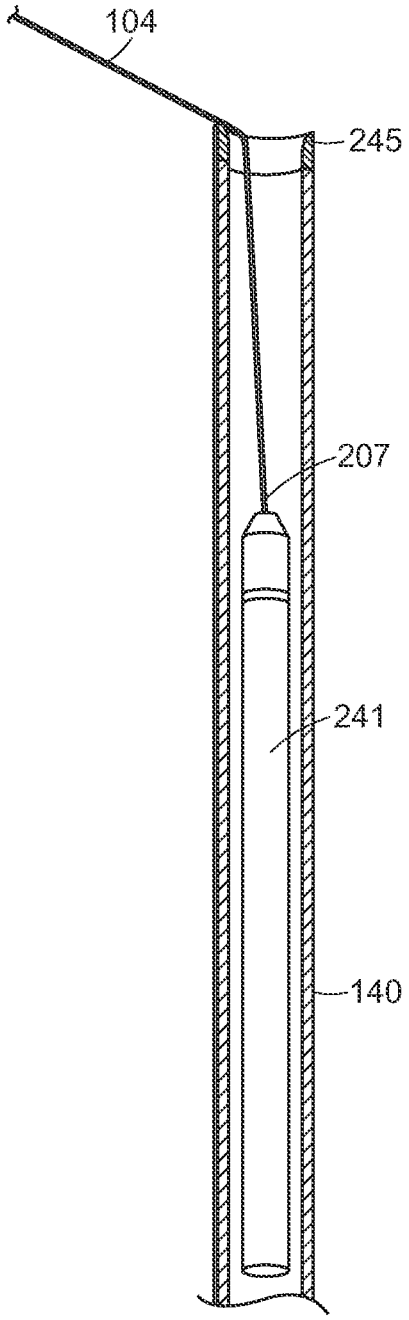
FIG. 2 is an enlarged cross-sectional view of a tube of the braiding system shown in FIG. 1 configured in accordance with embodiments of the present technology.

Each filament 104 is tensioned by a weight secured to a lower portion of the filament 104. For example, FIG. 2 is an enlarged cross-sectional view of an individual tube 140. In the embodiment illustrated in FIG. 2, the filament 104 includes an end portion 207 coupled to (e.g., tied to, wrapped around, etc.) a weight 241 positioned within the tube 140. The weight 241 can have a cylindrical or other shape and is configured to slide smoothly within the tube 140 as the filament 104 is paid out during the braiding process. The tubes 140 can further include an upper edge portion (e.g., rim) 245 that is rounded or otherwise configured to permit the filament 104 to smoothly pay out from the tube 140. As shown, the tubes 140 have a circular cross-sectional shape, and completely enclose the weights 241 and the filaments 104 disposed therein. In other embodiments, the tubes 140 may have other cross-sectional shapes, such as square, rectangular, oval, polygonal, etc., and may not completely enclose or surround the weights 241 and/or the filaments 104. For example, the tubes 140 may include slots, openings, and/or other features while still providing the necessary housing and restraint of the filaments 104.

The tubes 140 constrain lateral or "swinging" movement of the weights 241 and filaments 104 to inhibit significant swaying and tangling of these components along the full length of the filaments 104. This enables the system 100 to operate at higher speeds compared to systems in which filaments and/or tensioning means are non-constrained along their full lengths. Specifically, filaments that are not constrained may sway and get tangled with each other if a pause or dwell time is not incorporated into the process so that the filaments can settle. In many applications, the filaments 104 are very fine wires that would otherwise require significant pauses for settling without the full-length constraint and synchronization of the present technology. In some embodiments, the filaments 104 are all coupled to identical weights to provide for uniform tensions within the system 100. However, in other embodiments, some or all of the filaments 104 can be coupled to different weights to provide different tensions. Notably, the weights 241 may be made very small to apply a low tension on the filaments 104 and thus allow for the braiding of fine (e.g., small diameter) and fragile filaments.

Referring again to FIG. 1, and as described in further detail below with reference to FIGS. 3-8H, the drive units 120, 130 control the movement and location of the tubes 140. The drive units 120, 130 are configured to drive the tubes 140 in a series of discrete radial and arcuate paths relative to the central axis L that move the filaments 104 in a manner that forms a braided structure 105 (e.g., a woven tubular braid; "braid 105") on the mandrel 102. In particular, the tubes 140 each have an upper end portion 142 proximate the upper drive unit 120 and a lower end portion 144 proximate the lower drive unit 130. The drive units 120, 130 work in synchronization to simultaneously drive the upper end portion 142 and the lower end portion 144 (collectively "end portions 142, 144") of each individual tube 140 along the same path or at least a substantially similar spatial path. By driving both end portions 142, 144 of the individual tubes 140 in synchronization, the amount of sway or other undesirable movement of the tubes 140 is highly limited. As a result, the system 100 reduces or even eliminates pauses during the braiding process to allow the tubes to settle, which enables the system 100 to be operated at higher speeds than conventional systems. In other embodiments, the drive units 120, 130 can be arranged differently with respect to the tubes 130. For example, the drive units 120, 130 can be positioned at two locations that are not adjacent to the end portions 142, 144 of the tubes 140. Preferably, the drive units have a vertical spacing (e.g., arranged close enough to the end portions 142, 144 of the tubes 140) that provides stability to the tubes 140 and inhibit swaying or other unwanted movement of the tubes 140.

In some embodiments, the drive units 120, 130 are substantially identical and include one or more mechanical connections so that they move identically (e.g., in synchronization). For example, one of the drive units 120, 130 can be an active unit while the other of the drive units 120, 130 can be a slave unit driven by the active unit. In other embodiments, rather than a mechanical connection, an electronic control system coupled to the drive units 120, 130 is configured to move the tubes 140 in an identical sequence, spatially and temporally. In certain embodiments, where the tubes 140 are arranged conically with respect to the central axis L, the drive units 120, 130 can have the same components but with varying diameters.

In the embodiment illustrated in FIG. 1, the mandrel 102 is attached to a pull mechanism 106 configured to move (e.g., raise) the mandrel 102 along the central axis L relative to the tubes 140. The pull mechanism 106 can include a shaft 108 (e.g., a cable, string, rigid structure, etc.) that couples the mandrel 102 to an actuator or motor (not pictured) for moving the mandrel 102. As shown, the pull mechanism 106 can further include one or more guides 109 (e.g., wheels, pulleys, rollers, etc.) coupled to the frame 110 for guiding the shaft 108 and directing the force from the actuator or motor to the mandrel 102. During operation, the mandrel 102 can be raised away from the tubes 140 to extend the surface for creating the braid 105 on the mandrel 102. In some embodiments, the rate at which the mandrel 102 is raised can be varied in order to vary the characteristics of the braid 105 (e.g., to increase or decrease the braid angle (pitch) of the filaments 104 and thus the pore size of the braid 105). The ultimate length of the finished braid depends on the available length of the filaments 104 in the tubes 140, the pitch of the braid, and the available length of the mandrel 102.

In some embodiments, the mandrel 102 can have lengthwise grooves along its length to, for example, grip the filaments 104. The mandrel 102 can further include components for inhibiting rotation of the mandrel 102 relative to the central axis L during the braiding process. For example, the mandrel 102 can include a longitudinal keyway (e.g., channel) and a stationary locking pin slidably received in the keyway that maintains the orientation of the mandrel 102 as it is raised. The diameter of the mandrel 102 is limited on the large end only by the dimensions of the drive units 120, 130, and on the small end by the quantities and diameters of the filaments 104 being braided. In some embodiments, where the diameter of the mandrel 102 is small (e.g., less than about 4 mm), the system 100 can further include one or weights coupled to the mandrel 102. The weights can put the mandrel 102 under significant tension and prevent the filaments 104 from deforming the mandrel 102 longitudinally during the braiding process. In some embodiments, the weights can be configured to further inhibit rotation of the mandrel 102 and/or replace the use of a keyway and locking pin to inhibit rotation.

The system 100 can further include a bushing (e.g., ring) 117 coupled to the frame 110 via an arm 115. The mandrel 102 extends through the bushing 117 and the filaments 104 each extend through an annular opening between the mandrel 102 and the bushing 117. In some embodiments, the bushing 117 has an inner diameter that is only slightly larger than an outer diameter of the mandrel 102. Therefore, during operation, the bushing 117 forces the filaments 104 against the mandrel 102 such that the braid 105 pulls tightly against the mandrel 102. In some embodiments, the bushing 117 can have an adjustable inner diameter to accommodate filaments of different diameters. Similarly, in certain embodiments, the vertical position of the bushing 117 can be varied to adjust the point at which the filaments 104 converge to form the braid 105.

Figure 3:
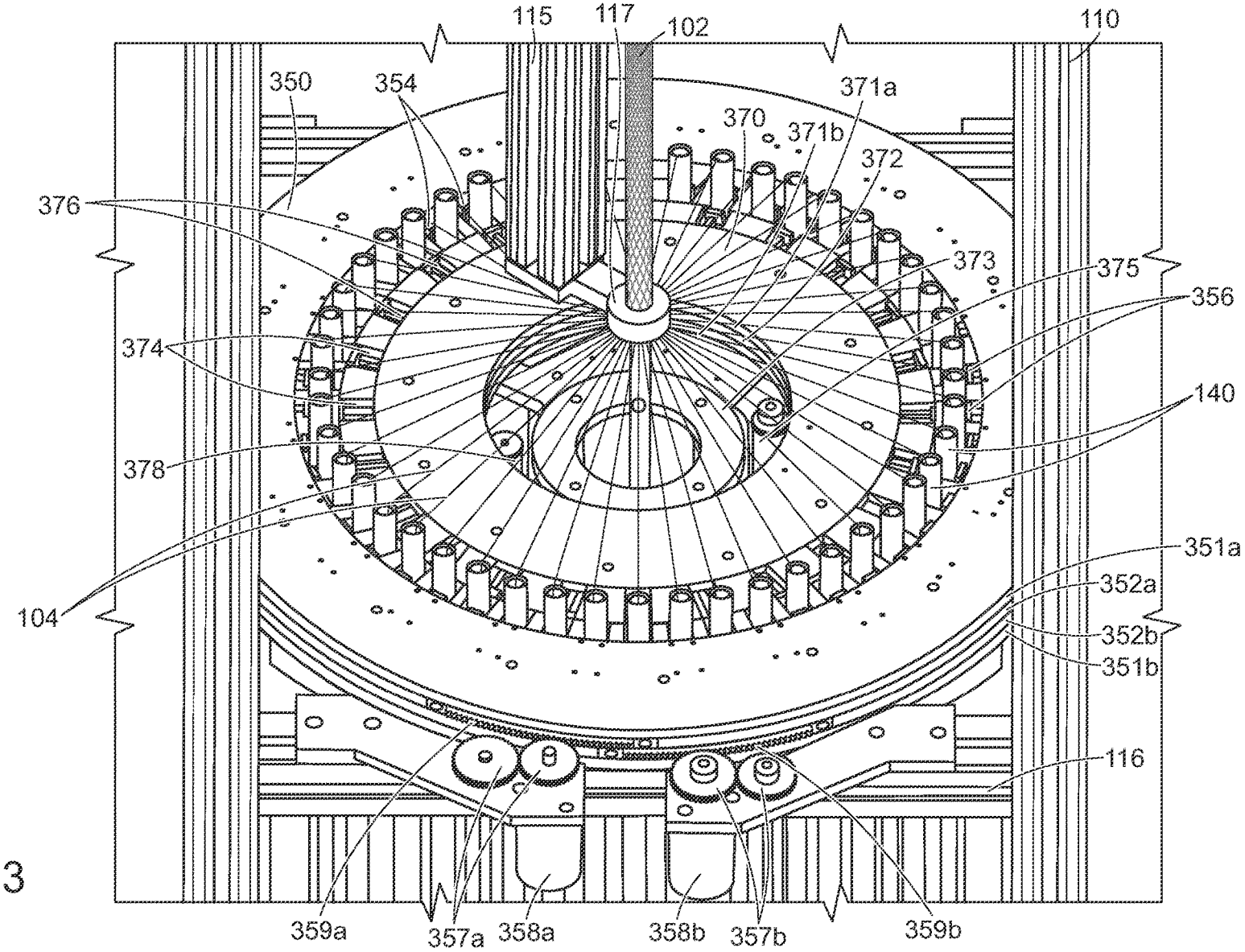
FIG. 3 is an isometric view of an upper drive unit of the braiding system shown in FIG. 1 configured in accordance with embodiments of the present technology.

FIG. 3 is an isometric view of the upper drive unit 120 shown in FIG. 1 configured in accordance with embodiments of the present technology. The upper drive unit 120 includes an outer assembly 350 and an inner assembly 370 (collectively "assemblies 350, 370") arranged concentrically about the central axis L (FIG. 1). The outer assembly 350 includes (i) outer slots (e.g., grooves) 354, (ii) outer drive members (e.g., plungers) 356 aligned with and/or positioned within corresponding outer slots 354, and (iii) an outer drive mechanism configured to move the outer drive members 356 radially inward through the outer slots 354. The number of outer slots 354 can be equal to the number of tubes 140 in the system 100, and the outer slots 354 are configured to receive the tubes 140 therein. In certain embodiments, the outer assembly 350 includes 48 outer slots 354. In other embodiments, the outer assembly 350 can have a different number of outer slots 354 such as 12 slots, 24 slots, 96 slots, or any other preferably even number of slots. The outer assembly 350 further includes an upper plate 351*a* and a lower plate 351*b* opposite the upper plate 351*a*. The upper plate 351*a* at least partially defines an upper surface of the outer assembly 350. In some embodiments, the lower plate 351*b* can be attached to the upper support structure 116 of the frame 110.

In the embodiment illustrated in FIG. 3, the outer drive mechanism of the outer assembly 350 includes a first outer cam ring 352*a* and a second outer cam ring 352*b* (collectively "outer cam rings 352") positioned between the upper and lower plates 351*a*, 351*b*. A first outer cam ring motor 358*a* can be an electric motor configured to drive the first outer cam ring 352*a* to move a first set of the outer drive members 356 radially inward to thereby move a first set of the tubes 140 radially inward. Likewise, a second outer cam ring motor 358*b* is configured to rotate the second outer cam ring 352*b* to move a second set of the outer drive members 356 radially inward to thereby move a second set of the tubes 140 radially inward. More particularly, the first outer cam ring motor 358*a* can be coupled to one or more pinions 357*a* configured to engage a corresponding first track 359*a* on the first outer cam ring 352*a*, and the second outer cam ring motor 358*b* can be coupled to one or more pinions 357*b* configured to engage a corresponding second track 359*b* on the second outer cam ring 352*b*. In some embodiments, as shown in FIG. 3, the first and second tracks 359*a*, 359*b* (collectively "tracks 359") extend only partially around the perimeter of the first and second outer cam rings 352*a*, 352*b* respectively. Accordingly, in such embodiments, the outer cam rings 352 are not configured to fully rotate about the central axis L. Rather, the outer cam rings 352 move through only a relatively small arc length (e.g., about 1°-5°, or about 5°-10°) about the central axis L. In operation, the outer cam rings 352 can be rotated in a first direction and a second direction (e.g., by reversing the motor) through the relatively small angle. In other embodiments, the tracks 359 extend around a larger portion of the perimeter, such as the entire perimeter, of the outer cam rings 352, and the outer cam rings 352 can be rotated more fully (e.g., entirely) about the central axis L.

The inner assembly 370 includes (i) inner slots (e.g., grooves) 374, (ii) inner drive members (e.g., plungers) 376 aligned with and/or positioned within corresponding ones of the inner slots 374, and (iii) an inner drive mechanism configured to move the inner drive members 376 radially outward through the inner slots 374. As shown, the number of inner slots 374 can be equal to one half the number of outer slots 354 (e.g., 24 inner slots 374) such that the inner slots 374 are configured to receive a subset (e.g., half) of the tubes 140 therein. The ratio of outer slots 354 to inner slots 374 can be different in other embodiments, such as one-to-one. In particular, in the embodiment illustrated in FIG. 3, the inner slots 374 are aligned with alternating ones of the tubes 140 and the outer slots 354 and, as described in further detail below, one of the outer cam rings 352 can be rotated to move the aligned tubes 140 into the inner slots 374. The inner assembly 370 can further include a lower plate 371*b* that is rotatably coupled to an inner support member 373. For example, in some embodiments, the rotatable coupling comprises a plurality of bearings disposed in a circular groove formed between the inner support member 373 and the lower plate 371*b*. The inner assembly 370 can further include an upper plate 371*a* opposite the lower plate 371*b* and at least partially defining an upper surface of the inner assembly 370.

In the embodiment illustrated in FIG. 3, the inner drive mechanism comprises an inner cam ring 372 positioned between the upper and lower plates 371*a*, 371*b*. An inner cam ring motor 378 is configured to drive (e.g., rotate) the inner cam ring 372 to move all of the inner drive members 376 radially outward to thereby move tubes 140 positioned in the inner slots 374 radially outward. The inner cam ring motor 378 can be generally similar to the first and second outer cam ring motors 358*a*, 358*b* (collectively "outer cam ring motors 358"). For example, the inner cam ring motor 378 can be coupled to one or more pinions configured to engage (e.g., mate with) a corresponding track on the inner cam ring 372 (obscured in FIG. 3; best illustrated in FIG. 6). In some embodiments, the track extends around only a portion of an inner perimeter of the inner cam ring 372, and the inner cam ring motor 378 is rotatable in a first direction and a second opposite direction to drive the inner cam ring 372 through only a relatively small arc length (e.g., about 1°-5°, about 5°-10°, or about 10°-20°) about the central axis L.

The inner assembly 370 further includes an inner assembly motor 375 configured to rotate the inner assembly 370 relative to the outer assembly 350. This rotation allows for the inner slots 374 to be rotated into alignment with different outer slots 354. The operation of the inner assembly motor 375 can be generally similar to that of the outer cam ring motors 358 and the inner cam ring motor 378. For example, the inner assembly motor 375 can rotate one or more pinions coupled to a track mounted on the lower plate 371*b* and/or the upper plate 371*a*.

In general, the upper drive unit 120 is configured to drive the tubes 140 in three distinct movements: (i) radially inward (e.g., from the outer slots 354 to the inner slots 374) via rotation of the outer cam rings 352 of the outer assembly 350; (ii) radially outward (e.g., from the inner slots 374 to the outer slots 354) via rotation of the inner cam ring 372 of the inner assembly 370; and (iii) circumferentially via rotation of the inner assembly 370. Moreover, as explained in more detail below with reference to FIG. 9, in some embodiments these movements can be mechanically independent and a system controller (not pictured; e.g., a digital computer) can receive input from a user via a user interface indicating one or more operating parameters for these movements as well as the movement of the mandrel 102 (FIG. 1). For example, the system controller can drive each of the four motors in the drive units 120, 130 (e.g., the outer cam ring motors 358, the inner cam ring motor 378, and the inner assembly motor 375) with closed loop shaft rotation feedback. The system controller can relay the parameters to the various motors (e.g., via a processor), thereby allowing manual and/or automatic control of the movements of the tubes 140 and the mandrel 102 to control formation of the braid 105. In this way the system 100 can be parametric and many different forms of braid can be made without modification of the system 100. In other embodiments, the various motions of the drive units 120, 130 are mechanically sequenced such that turning a single shaft indexes the drive units 120, 130 through an entire cycle.

Figure 4A:
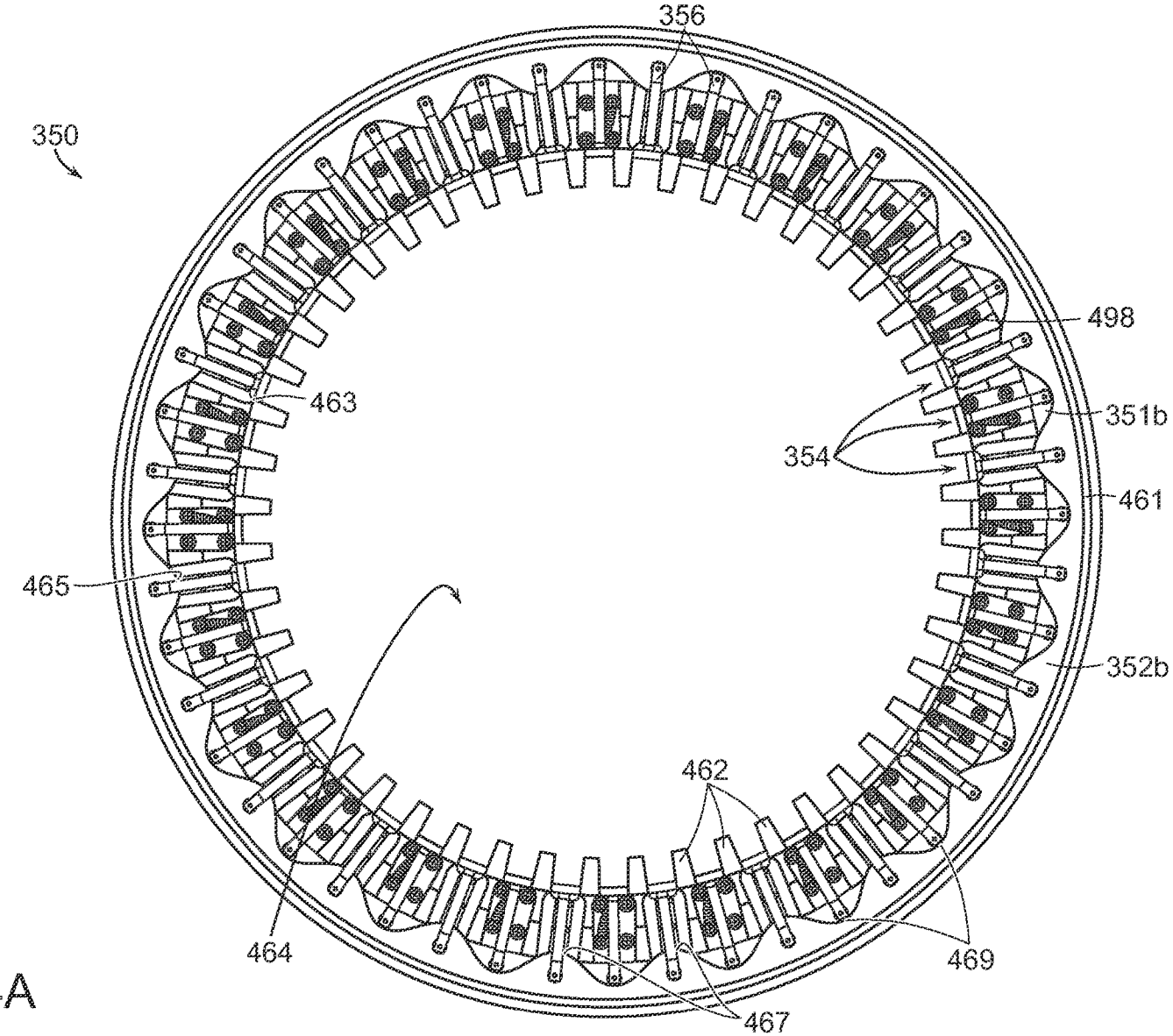
FIG. 4A is a top view.
Figure 4B:
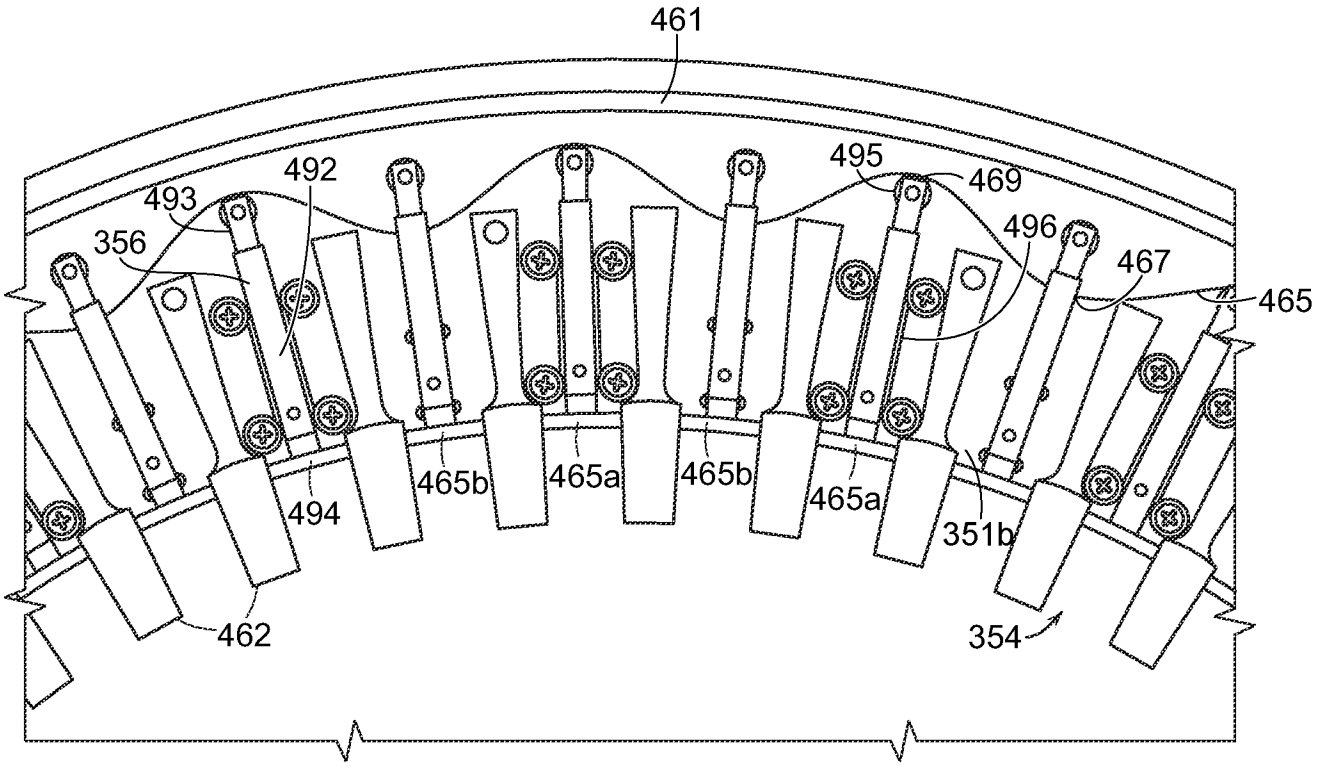
FIG. 4B is an enlarged top view, of an outer assembly of the upper drive unit shown in FIG. 3 configured in accordance with embodiments of the present technology.

Further details of the drive mechanisms of the assemblies 350, 370 are described with reference to FIGS. 4A-6. In particular, FIG. 4A is a top view, and FIG. 4B is an enlarged top view, of an embodiment of the outer assembly 350 of the upper drive unit 120. The upper plate 351*a* and the first outer cam ring 352*a* are not pictured to more clearly illustrate the operation of the outer assembly 350. Referring to both FIGS. 4A and 4B together, the lower plate 351*b* has an inner edge 463 that defines a central opening 464. A plurality of wall portions 462 are arranged circumferentially around the lower plate 351*b* and extend radially inward beyond the inner edge 463 of the lower plate 351*b*. Each pair of adjacent wall portions 462 defines one of the outer slots 354 in the central opening 464. The wall portions 462 can be fastened to the lower plate 351*b* (e.g., using bolts, screws, welding, etc.) or integrally formed with the lower plate 351*b*. In other embodiments, all or a portion of the wall portions 462 can be on the upper plate 351*a* rather than the lower plate 351*b* of the outer assembly 350.

Figure 6:
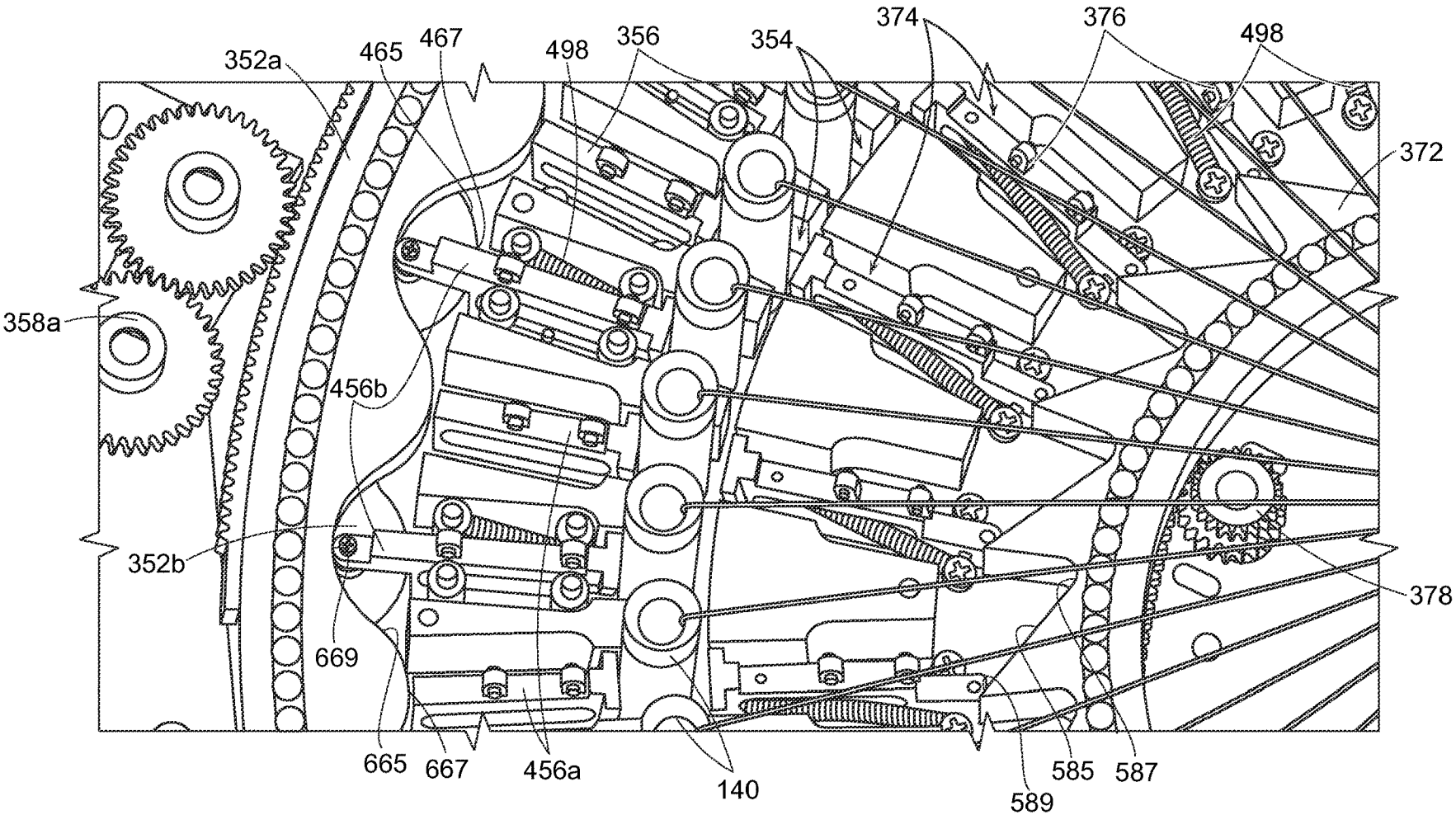
FIG. 6 is an enlarged isometric view of a portion of the upper drive unit shown in FIG. 3 configured in accordance with embodiments of the present technology.

The second outer cam ring 352*b* includes an inner surface 465 having a periodic (e.g., oscillating) shape including a plurality of peaks 467 and troughs 469. In the illustrated embodiment, the inner surface 465 has a smooth sinusoidal shape, while in other embodiments, the inner surface 465 can have other periodic shapes such as a saw-tooth shape. The second outer cam ring 352*b* is rotatably coupled to the lower plate 351*b* such that the second outer cam ring 352*b* and the lower plate 351*b* can rotate with respect to each other. For example, in some embodiments, the rotatable coupling comprises a plurality of bearings disposed in a first circular channel (obscured in FIG. 4A in 4B) formed between the lower plate 351*b* and the second outer cam ring 352*b*. In the illustrated embodiment, the second outer cam ring 352*b* includes a second circular channel 461 for rotatably coupling the second outer cam ring 352*b* to the first outer cam ring 352*a* via a plurality of bearings. In some embodiments, the first circular channel can be substantially identical to the second circular channel 461. Although not pictured in FIGS. 4A and 4B, as shown in FIG. 6, the first outer cam ring 352*a* can be substantially identical to the second outer cam ring 352*b*.

As further shown in FIGS. 4A and 4B, the outer drive members 356 are positioned in between adjacent wall portions 462. Each of the outer drive members 356 is identical, although alternating ones of the outer drive members 356 are oriented differently within the outer assembly 350. For example, adjacent ones of the outer drive members 356 can be flipped vertically relative to a plane defined by the lower plate 351*b*. More particularly, with reference to FIG. 4B, the outer drive members 356 each comprise a body portion 492 coupled to a push portion 494. The push portions 494 are configured to engage (e.g., contact and push) tubes positioned within the outer slots 354.

Referring to FIG. 4B, the body portions 492 further comprise a stepped portion 491 that does not engage the outer cam rings 352, and an extension portion 493 that engages only one of the outer cam rings 352. For example, a first set of outer drive members 456*a* have an extension portion 493 that continuously contacts the inner surface 465 of the second outer cam ring 352*b*, but does not contact an inner surface of the first outer cam ring 352*a*. In particular, the extension portions 493 of the first set of outer drive members 456*a* do not contact the inner surface of the first outer cam ring 352*a* as they extend below the first outer cam ring 352*a*. Likewise, as best seen in FIG. 6, a second set of outer drive members 456*b* have extension portions 493 that continuously contact the inner surface of the first outer cam ring 352*a*, but do not contact the second outer cam ring 352*b*. In particular, the extension portions 493 of the second set of outer drive members 456*b* do not contact the inner surface 465 of the second outer cam ring 352*b* as they extend above the second outer cam ring 352*b*. In this manner, each of the outer cam rings 352 is configured to drive only one set (e.g., half) of the outer drive members 356. Moreover, as shown in FIG. 4B, the outer drive members 356 can further include bearings 495 or other suitable mechanisms for providing a smooth coupling between the outer drive members 356 and the outer cam rings 352.

The first set of outer drive members 456*a* can be coupled to the lower plate 351*b* in between alternating, adjacent pairs of the wall portions 462. Similarly, in some embodiments, the second set of outer drive member 456*b* can be coupled to the upper plate 351*a* and positioned in between alternating, adjacent pairs of the wall portions 462 when the outer assembly 350 is assembled (e.g., when the upper plate 351*a* is coupled to the lower plate 351*b*). By mounting the second set of outer drive members 456*b* to the upper plate 351*a*, the same mounting system can be used for each of the outer drive members 356. For example, the outer drive members 356 can be slidably coupled to a frame 496 that is attached to one of the upper or lower plates 351*a*, 351*b* by a plurality of screws 497. In other embodiments, all of the outer drive members 356 can be attached (e.g., via the frame 496 and screws 497) to the lower plate 351*b* or the upper plate 351*a*. As further shown in FIGS. 4A and 4B, a biasing member 498 (e.g., a spring) extends between each outer drive member 356 and the corresponding frame 496, and exerts a radially outward biasing force against the outer drive members 356.

In operation, the outer drive members 356 are driven radially inward by rotation of the periodic inner surfaces of the outer cam rings 352, and returned radially outward by the biasing members 498. For example, in FIGS. 4A and 4B, each of the outer drive members 356 is in a radially retracted position. In the radially retracted position, the troughs 469 of the inner surface 465 of the second outer cam ring 352*b* are aligned with the first set of outer drive members 456*a*. In this position, the extension portions 493 of the outer drive members 356 are at or nearer to the troughs 469 than the peaks 467 of the inner surface 465. To move the first set of outer drive members 456*a* radially inward, rotation of the second outer cam ring 352*b* moves the peaks 467 of the inner surface 465 into radial alignment with the first set of outer drive members 456*a*. Since the outward force of the biasing members 498 urges the extension portions 493 into continuous contact with the inner surface 465, the extension portions 493 move radially inward as the inner surface 465 rotates from trough 469 to peak 467. To subsequently return the first set of outer drive members 456*a* to a retracted position, the second outer cam ring 352*b* rotates to move the troughs 469 into radial alignment with the first set of outer drive members 456*a*. As this rotation occurs, the radially outward biasing force of the biasing members 498 retracts the first set of outer drive members 456*a* into the space provided by the troughs 469. The operation of the second set of outer drive members 456*b* and the first outer cam ring 352*a* can be carried out in a substantially similar or identical manner.

Figure 5:
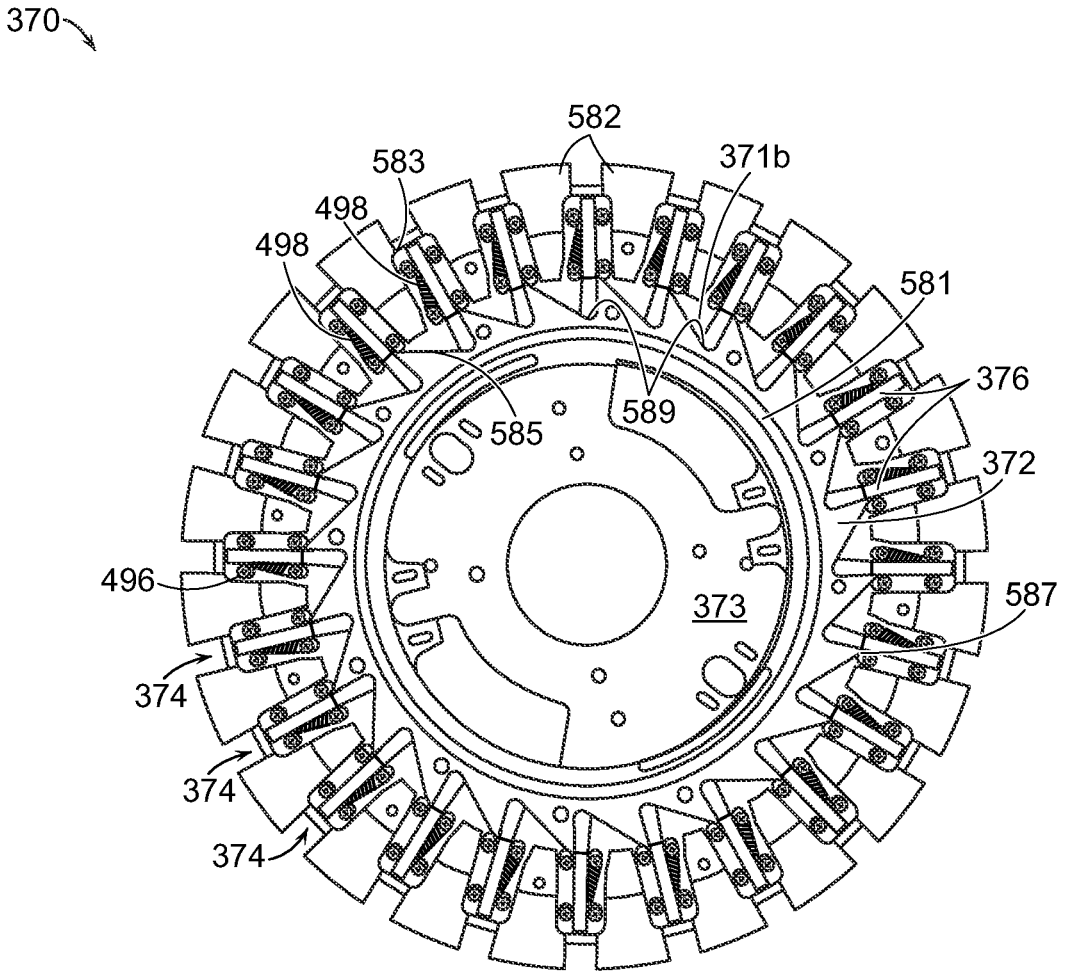
FIG. 5 is a top view of an inner assembly of the upper drive unit shown in FIG. 3 configured in accordance with embodiments of the present technology.

FIG. 5 is a top view of the inner assembly 370 of the upper drive unit 120. The upper plate 371*a* is not pictured to more clearly illustrate the operation of the inner assembly 370. As shown, the lower plate 371*b* has an outer edge 583, and the inner assembly 370 includes a plurality of wall portions 582 arranged circumferentially about the lower plate 371*b* and extending radially outward beyond the outer edge 583. Each pair of adjacent wall portions 582 defines one of the inner slots 374. The wall portions 582 can be fastened to the lower plate 371*b* (e.g., using bolts, screws, welding, etc.) or integrally formed with the lower plate 371*b*. In other embodiments, at least some of the wall portions 582 are on the upper plate 371*a* rather than the lower plate 371*b* of the inner assembly 370.

The inner cam ring 372 includes an outer surface 585 having a periodic (e.g., oscillating) shape including a plurality of peaks 587 and troughs 589. In the illustrated embodiment, the outer surface 585 has a saw-tooth shape, while in other embodiments, the outer surface 585 can have other periodic shapes such as a smooth sinusoidal shape. The inner cam ring 372 is rotatably coupled to the lower plate 371*b* by, for example, a plurality of ball bearings disposed in a first circular channel (obscured in the top view of FIG. 5) formed between the lower plate 371*b* and the inner cam ring 372. In the illustrated embodiment, the inner cam ring 372 includes a second circular channel 581 for rotatably coupling the inner cam ring 372 to the upper plate 371*a* via, for example, a plurality of ball bearings. In some embodiments, the first circular channel can be substantially identical to the second circular channel 581. The inner cam ring 372 can accordingly rotate with respect to the upper and lower plates 371*a* and 371*b*.

As further shown in FIG. 5, the inner drive members 376 are coupled to the lower plate 371*b* between adjacent wall portions 582. Each of the inner drive members 376 is identical, and the inner drive members 376 can be identical to the outer drive members 356 (FIGS. 4A and 4B). For example, as described above, each of the inner drive members 376 can have a body 492 including a stepped portion 491 and an extension portion 493, and the inner drive members 376 can each be slidably coupled to a frame 496 mounted to the lower plate 371*b*. Likewise, biasing members 498 extending between each inner drive member 376 and their corresponding frame 496 exert a radially inward biasing force against the inner drive members 376. As a result, the extension portions 493 of the inner drive members 376 continuously contact the outer surface 585 of the inner cam ring 372.

In operation, rotation of the outer periodic surface 585 drives the inner drive members 376 radially outward, while the biasing members 498 retract the inner drive members 376 radially inward. For example, as shown in FIG. 5, the inner drive members 376 are in a radially retracted position. In the radially retracted position, the troughs 589 of the outer surface 585 of the inner cam ring 372 are radially aligned with the inner drive members 376 such that the extension portions 593 of the inner drive members 376 are at or nearer to the troughs 589 than the peaks 587 of the outer surface 585. To move the inner drive members 376 radially outward, the inner cam ring 372 rotates to move the peaks 587 of the outer surface 585 into radial alignment with the inner drive members 376. Since the biasing members 498 urge the extension portions 493 into continuous contact with the outer surface 585, the inner drive members 376 are continuously forced radially inward as the outer surface 585 rotates from trough 589 to peak 587. To subsequently return the inner drive members 576 to the radially retracted position, the inner cam ring 372 is rotated to move the troughs 589 into radial alignment with the inner drive members 576. As this rotation occurs, the radially inward biasing force provided by the biasing members 598 inwardly retracts the inner drive members 376 into the space provided by the troughs 589.

Notably, each of the drive members in the system 100 is actuated by the rotation of a cam ring that provides a consistent and synchronized actuation force to all of the drive members. In contrast, in conventional systems where filaments are actuated individually or in small sets by separately controlled actuators, if one actuator is out of synchronization with another, there is a possibility of tangling of filaments.

FIG. 6 is an enlarged isometric view of a portion of the upper drive unit 120 shown in FIG. 3 that illustrates the synchronous (e.g., reciprocal) action of the assemblies 350, 370. The upper plate 351*a* of the outer assembly 350 and the upper plate 371*a* of the inner assembly 370 are not shown in FIG. 6 to more clearly illustrate the operation of these components. In the illustrated embodiment, all of the tubes 140 are positioned in the outer slots 354 of the outer assembly 350. Accordingly, each of the outer drive members 356 is in a retracted position so that there is space for the tubes 140 in the outer slots 354. More specifically, as shown, (i) the troughs 469 (partially obscured; illustrated in FIGS. 4A and 4B) of the inner surface 465 of the second outer cam ring 352*b* are radially aligned with the first set of outer drive members 456*a*, (ii) troughs 669 of a periodic inner surface 665 of first outer cam ring 352*a* are radially aligned with the second set of outer drive members 456*b*, and (iii) the biasing members 498 coupled to the outer drive members 356 have a minimum length (e.g., a fully compressed position). In contrast, in the illustrated embodiment, the inner drive members 376 are in a fully extended position in which the inner drive members 376 are in contact with the outer surface 585 of the inner cam ring 372 at or nearer to the peaks 587 of the outer surface 585 than the troughs 589. In this position, the biasing members 498 coupled to the inner drive members 376 have a maximum length (e.g., a fully expanded position).

As further illustrated in FIG. 6, the first set of outer drive members 456*a* are radially aligned with the inner slots 374. In this position the first set of outer drive members 456*a* can move the tubes 140 in the outer slots 354 corresponding to the first set of outer drive members 456*a* to the inner slots 374. To do so, the second outer cam ring motor 358*b* (FIG. 3) can be actuated to rotate (e.g., either clockwise or counterclockwise) the second outer cam ring 352*b* and thereby align the peaks 467 of the inner surface 465 with the first set of outer drive members 456*a*. The inner surface 465 accordingly drives the first set of outer drive members 456*a* radially inward. At the same time, the inner cam ring motor 378 can be actuated to rotate the inner cam ring 372 (e.g., in the counterclockwise direction) to align the troughs 589 of the outer surface 585 of the inner cam ring 372 with the inner drive members 376. This movement of the inner cam ring 372 causes the inner drive members 376 to retract radially inward. In this manner, the assemblies 350, 370 can be configured retain the tubes 140 in a well-controlled space. More specifically, at the same time that the outer drive members 356 move radially inward, the inner drive members 376 retract a corresponding amount to maintain the space for the tubes 140, and vice versa. This keeps the tubes 140 moving in a discrete, predictable pattern determined by a control system of the system 100.

Figure 7:
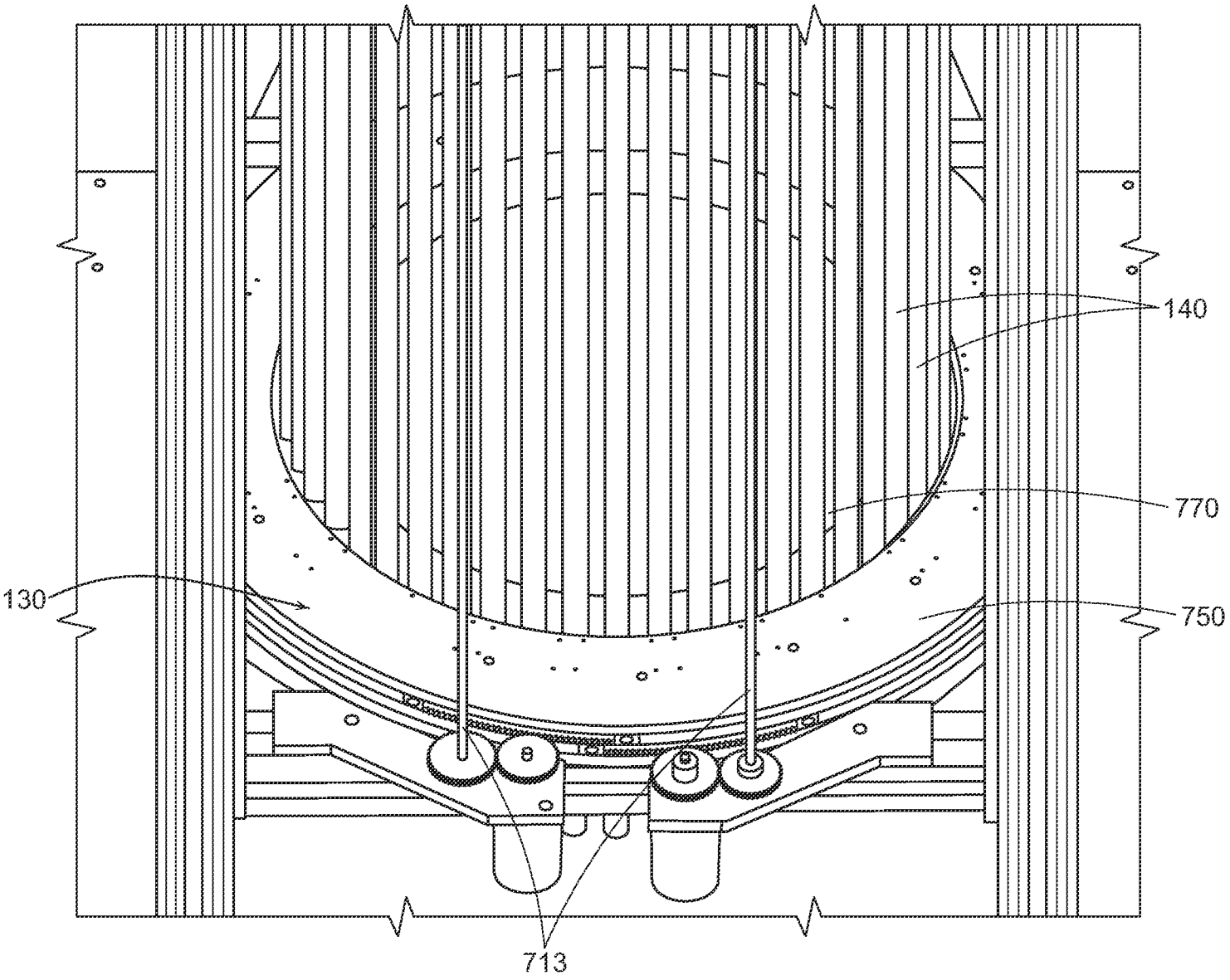
FIG. 7 is an isometric view of a lower drive unit of the braiding system shown in FIG. 1 configured in accordance with embodiments of the present technology.

FIG. 7 is an isometric view of the lower drive unit 130 shown in FIG. 1 configured in accordance with embodiments of the present technology. The lower drive unit 130 has components and functions that are substantially the same as or identical to the upper drive unit 120 described in detail above with reference to FIGS. 3-6. For example, the lower drive unit 130 includes an outer assembly 750 and an inner assembly 770. The outer assembly 750 can include (i) outer slots, (ii) outer drive members aligned with and/or positioned within corresponding outer slots, and (iii) an outer drive mechanism configured to move the outer drive members radially inward through the outer slots, etc. Likewise, the inner assembly 770 can include (i) inner slots, (ii) inner drive members aligned with and/or positioned within corresponding inner slots, and an inner drive mechanism configured to move the inner drive members radially outward through the inner slots, etc.

The inner drive mechanisms (e.g., inner cam rings) of the drive units 120, 130 move in a substantially identical sequence both spatially and temporally to drive the upper portion and lower portion of each individual tube 140 along the same or a substantially similar spatial path. Likewise, the outer drive mechanisms (outer cam rings) of the drive units 120, 130 move in a substantially identical sequence both spatially and temporally. In some embodiments, the drive units 120, 130 are synchronized using a mechanical connection. For example, as shown in FIG. 7, jackshafts 713 can mechanically couple corresponding components of the inner and outer drive mechanisms of the drive units 120, 130. More specifically, the jackshafts 713 mechanically couple the first outer cam ring 352*a* of the upper drive unit 120 to a matching first outer ring cam in the lower drive unit 130, and the second outer cam ring 352*b* of the upper drive unit 120 to a matching second outer ring cam in the lower drive unit 130. Jackshafts 713 (not pictured in FIG. 7) can similarly couple the inner cam ring 372 and the inner assembly 370 (e.g., for rotating the inner assembly 370) to corresponding components in the lower drive unit 130. Including separate motors on both drive units 120, 130 avoids torsional whip in the jackshafts while assuring motion synchronization between the drive units 120, 130. In some embodiments, the motors in one of the drive 120, 130 are closed loop controlled, while the motors in the other of the drive units 120, 130 act as slaves.

In general, the drive units 120, 130 move one of two sets of tubes 140 (and the filaments positioned within those tubes) at a time. Each set consists of alternating ones of the tubes 140 and therefore one half of the total number of tubes 140. When the drive units 120, 130 move a set, the set is moved (i) radially inward, (ii) rotated past the other set, and then (iii) moved radially outward. The sequence is then applied to the other set, with rotation happening in the opposite direction. That is, one set moves around the central axis L (FIG. 1) in a clockwise direction, while the other set moves around the central axis L in a counter-clockwise direction. All of the tubes 140 of each set move simultaneously and, when one set is in motion, the other set is stationary. This general cycle is repeated to form the braid 105 on the mandrel 102 (FIG. 1).

FIGS. 8A-8H are schematic views more particularly showing the movement of six tubes within the upper drive unit 120 at various stages in a method of forming a braided structure (e.g., the braid 105) in accordance with embodiments of the present technology. While reference is made to the movement of the tubes within the upper drive unit 120, the illustrated movement of the tubes is substantially the same or even identical in the lower drive unit 130. Moreover, while only six tubes are shown in FIGS. 8A-8H for case of explanation and understanding, one skilled in the art will readily understand that the movement of the six tubes is representative of any number of tubes (e.g., 24 tubes, 48 tubes, 96 tubes, or other numbers of tubes).

Figure 8A:
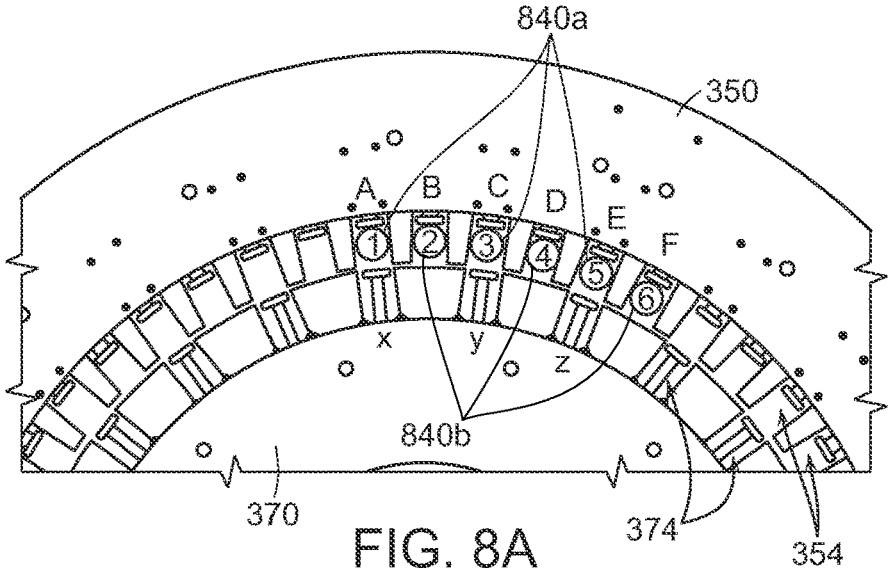
FIGS. 8A-8H are enlarged, schematic views of the upper drive unit shown in FIG. 3 at various stages in a method of forming a braided structure in accordance with embodiments of the present technology.

Referring first to FIG. 8A, the six tubes (e.g., the tubes 140) are individually labeled 1-6 and are all initially positioned in separate outer slots 354 of the outer assembly 350, labeled A-F, respectively. A first set of tubes 840*a* (including tubes 1, 3, and 5) positioned in the outer slots 354 labeled A, C, E are radially aligned with corresponding inner slots 374 labeled X-Z of the inner assembly 370. In contrast, a second set of tubes 840*b* (including tubes 2, 4, and 6) positioned in the outer slots 354 labeled B, D, and F are not radially aligned with any of the inner slots 374 of the inner assembly 370. The reference numerals A-F for the outer slots 354, X-Z for the inner slots 374, and 1-6 for the tubes are reproduced in each of FIGS. 8A-8H in order to illustrate the relative movement of these components.

Figure 8B:
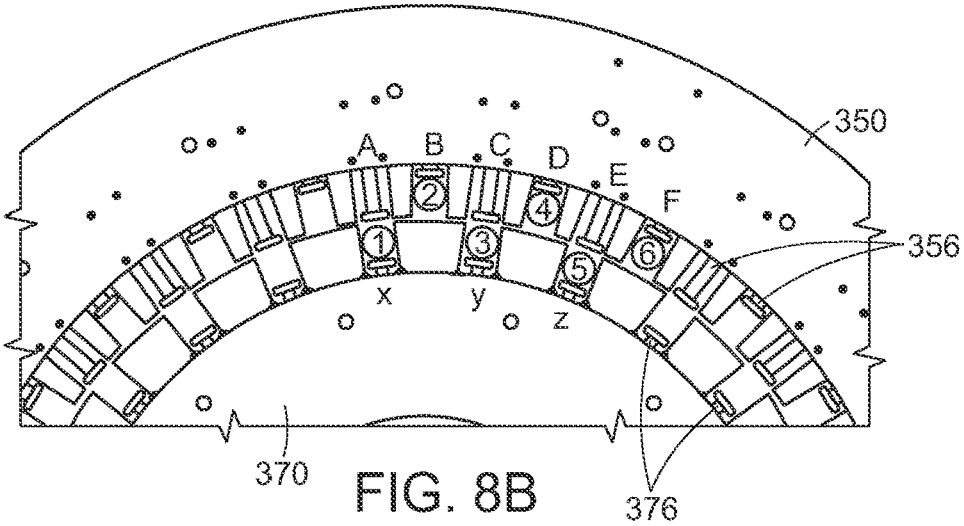

Referring next to FIG. 8B, the first set of tubes 840*a* is moved radially inward from the outer slots 354 of the outer assembly 350 to the inner slots 374 of the inner assembly 370. In particular, the outer drive members 356 aligned with the first set of tubes 840*a* move radially inward and drive the first set of tubes 840*a* radially inward into the inner slots 374. In some embodiments, at the same time, the inner drive members 376 can be retracted radially inward through the inner slots 374 to provide space for the first set of tubes 840*a* to be moved into the inner slots 374. In this manner, the outer assembly 350 and inner assembly 370 move in concert with each other to manipulate the space provided for the first set of tubes 840*a*.

Figure 8C:
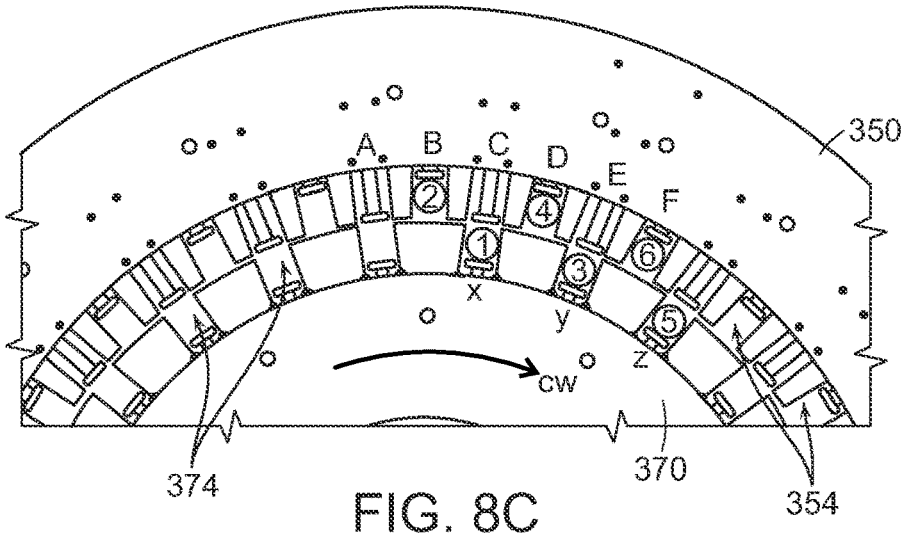

Next, as shown in FIG. 8C, the inner assembly 370 rotates in a first direction (e.g., in the clockwise direction indicated by the arrow CW) to align the inner slots 374 with a different set of the outer slots 354. In the embodiment illustrated in FIG. 8C, the inner slots 374 are aligned with a different set of outer slots 354 that are two slots away. For example, while the inner slot 374 labeled Y was initially aligned with the outer slot 374 labeled C (FIG. 8A), after rotation the inner slot 374 labeled Y is aligned with the outer slot 354 labeled E. Accordingly, this step passes the filaments in the first set of tubes 840*a* under the filaments in the second set of tubes 840*b*.

Figure 8D:
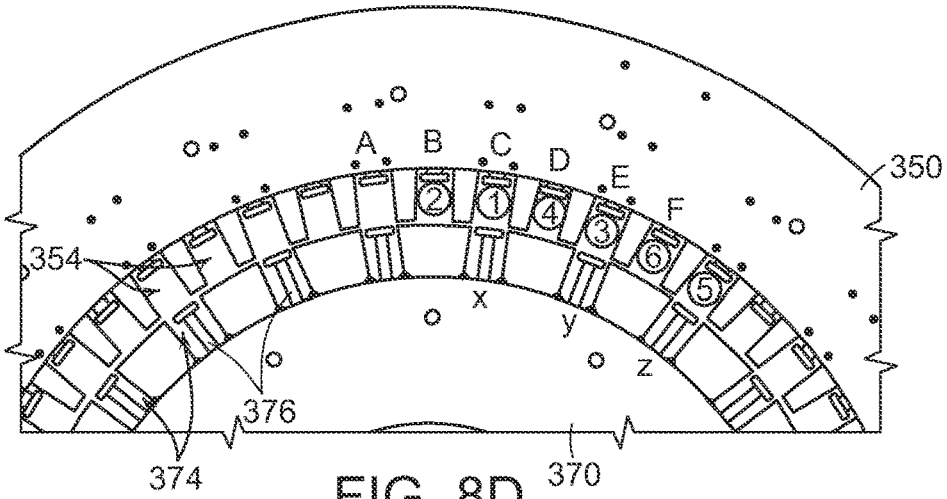

Referring next to FIG. 8D, the first set of tubes 840*a* is moved radially outward from the inner slots 374 of the inner assembly 370 to the outer slots 354 of the outer assembly 350. In particular, the inner drive members 376 move radially outward through the inner slots 374 and drive the first set of tubes 840*a* radially outward into the outer slots 354 aligned with the inner slots 374. In some embodiments, at the same time, the outer drive members 356 are retracted radially outward through the aligned outer slots 354 to provide space for the first set of tubes 840*a* to be moved into the outer slots 354. Notably, as illustrated in FIGS. 8B-8D, the second set of tubes 840*b* is stationary during each step in which the first set of tubes 840*a* is moved.

Figure 8E:
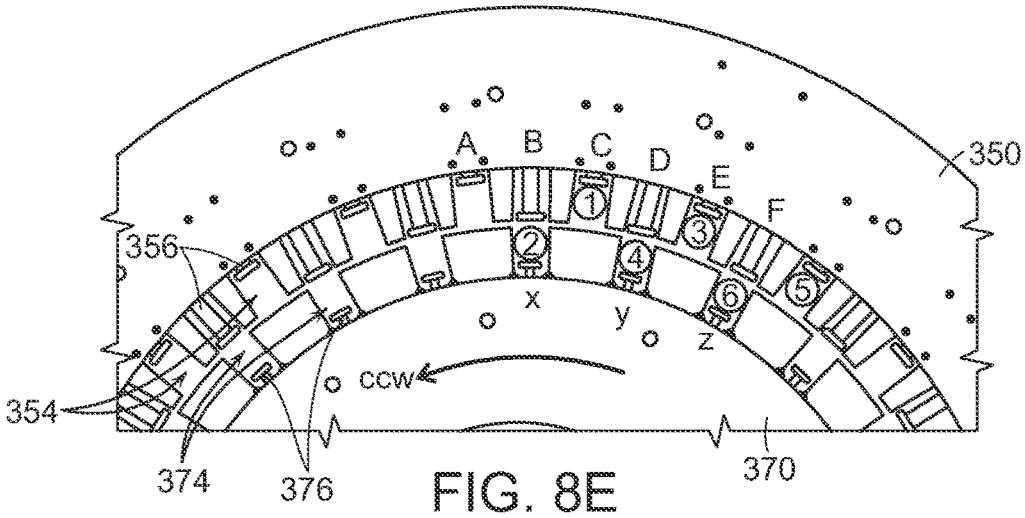

Next, as shown in FIG. 8E, the inner assembly 370 is rotated in a second direction (e.g., in the counterclockwise direction indicated by the arrow CCW) to align the inner slots 374 with different outer slots 354—i.e., those holding the second set of tubes 840*b*. In other embodiments the inner assembly 370 can be rotated in the first direction to align the inner slots 374 with different outer slots 354. In the embodiment illustrated in FIG. 8E, the inner assembly 370 is rotated to align each inner slot 374 with a different outer slot 354 that is one slot away (e.g., an adjacent outer slot 354). For example, while the inner slot 374 labeled X was previously aligned with the outer slot 354 labeled C (FIG. 8D), after rotation the inner slot 374 labeled X is aligned with the outer slot 354 labeled B. Subsequent to rotating the inner assembly 370, the second set of tubes 840*b* moves radially inward from the outer slots 354 of the outer assembly 350 to the inner slots 374 of the inner assembly 370. In particular, the outer drive members 356 aligned with the second set of tubes 840*b* move radially inward through the outer slots 354 and drive the second set of tubes 840*b* radially inward into the inner slots 374 while, at the same time, the inner drive members 376 retract radially inward through the inner slots 374 to provide space for the second set of tubes 840*b* to be moved into the inner slots 374.

Figure 8F:
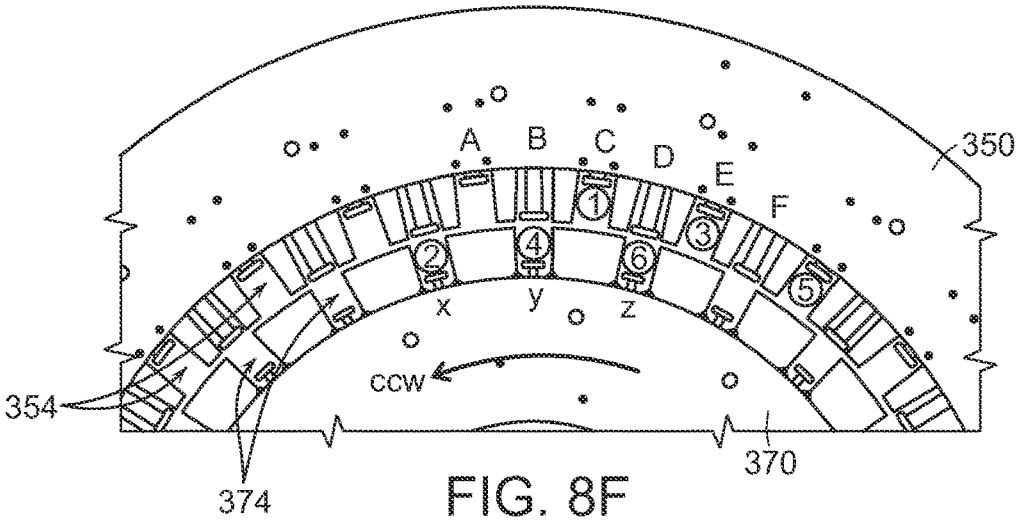

Referring next to FIG. 8F, the inner assembly 370 is rotated in the second direction (e.g., in the clockwise direction indicated by the arrow CCW) to align the inner slots 374 with a different set of the outer slots 354. In the embodiment illustrated in FIG. 8F, the inner assembly 370 is rotated to align each inner slot 374 with a different outer slot 354 that is two slots away. For example, while the inner slot 374 labeled Y was previously aligned with the outer slot 354 labeled D (FIG. 8E), after rotation the inner slot 374 labeled Y is aligned with the outer slot 354 labeled B. Accordingly, this step passes the filaments in the second set of tubes 840*b* under the filaments in the first set of tubes 840*a*.

Figure 8G:
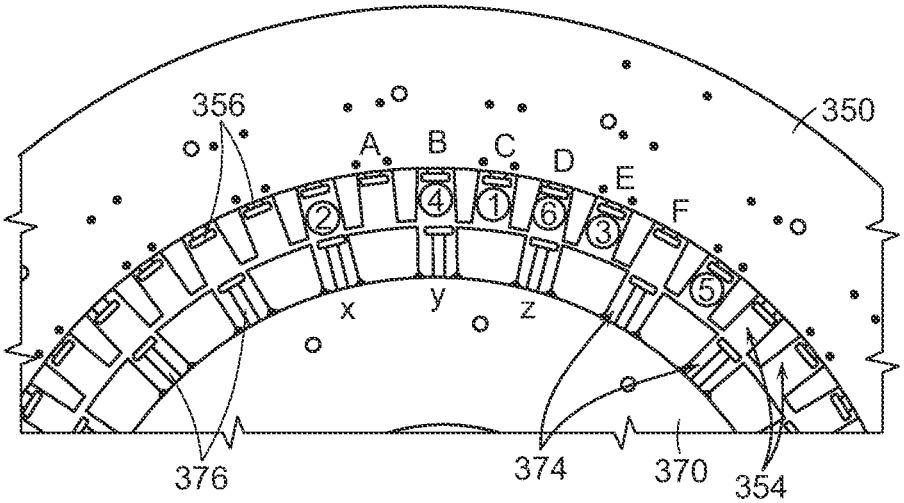

Next, as shown in FIG. 8G the second set of tubes 840*b* is moved radially outward from the inner slots 374 of the inner assembly 370 to the outer slots 354 of the outer assembly 350. In particular, the inner drive members 376 move radially outward through the inner slots 374 and drive the first set of tubes 840*a* radially outward into the outer slots 354 aligned with the inner slots 374. In some embodiments, at the same time, the outer drive members 356 can be retracted radially outward through the outer slots 354 in order to provide space for the first set of tubes 840*a* to be moved into the outer slots 354. Notably, as illustrated in FIGS. 8E-8G, the first set of tubes 840*a* is stationary during each step in which the second set of tubes 840*b* is moved.

Figure 8H:
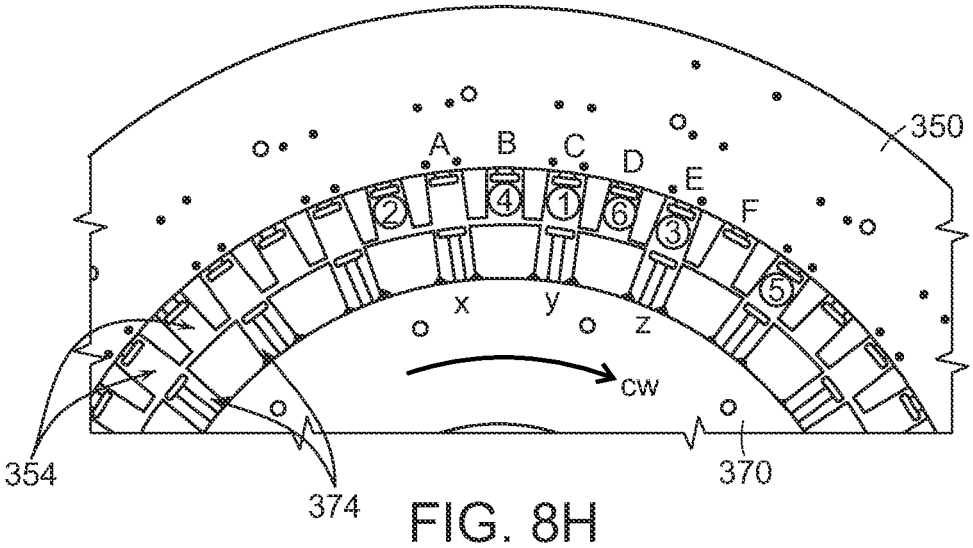

Finally, as shown in FIG. 8H, the inner assembly 370 rotates in the first direction (e.g., in the clockwise direction indicated by the arrow CCW) to align the inner slots 374 with different ones of the outer slots 354—i.e., those holding the first set of tubes 840*a*. In other embodiments the inner assembly 370 rotates in the second direction to align the inner slots 374 with different ones of the outer slots 354. In the embodiment illustrated in FIG. 8H, rotation of the inner assembly 370 aligns the inner slots 374 with a different set of outer slots 354 that are one slot away (e.g., an adjacent outer slot 354). For example, while the inner slot labeled Y was previously aligned with the outer slot 354 labeled C (FIG. 8G), after rotation the inner slot 374 labeled Y is aligned with the outer slot 354 labeled B. Thus, the inner assembly 370 and outer assembly 350 can be returned to the initial position illustrated in FIG. 8A. In contrast, each tube in the first set of tubes 840*a* has been rotated in the first direction (e.g., rotated two outer slots 354 in the clockwise direction) relative to the initial position shown in FIG. 8A, and each tube in the second set of tubes 840*b* has been rotated in the second direction (e.g., rotated two outer slots 354 in the counterclockwise direction) relative to the initial position of FIG. 8A.

The steps illustrated in FIGS. 8A-8H can subsequently be repeated to form a cylindrical braid on the mandrel as the first and second sets of tubes 840*a*, 840*b*—and the filaments held therein—are repeatedly passed by each other, rotating in opposite directions, sequentially alternating between radially outward passes relative to the other set and radially inward passes relative to the other set. One skilled in the art will recognize that the direction of rotation, the distance of each rotation, etc., can be varied without departing from the scope of the present technology.

Figure 9:
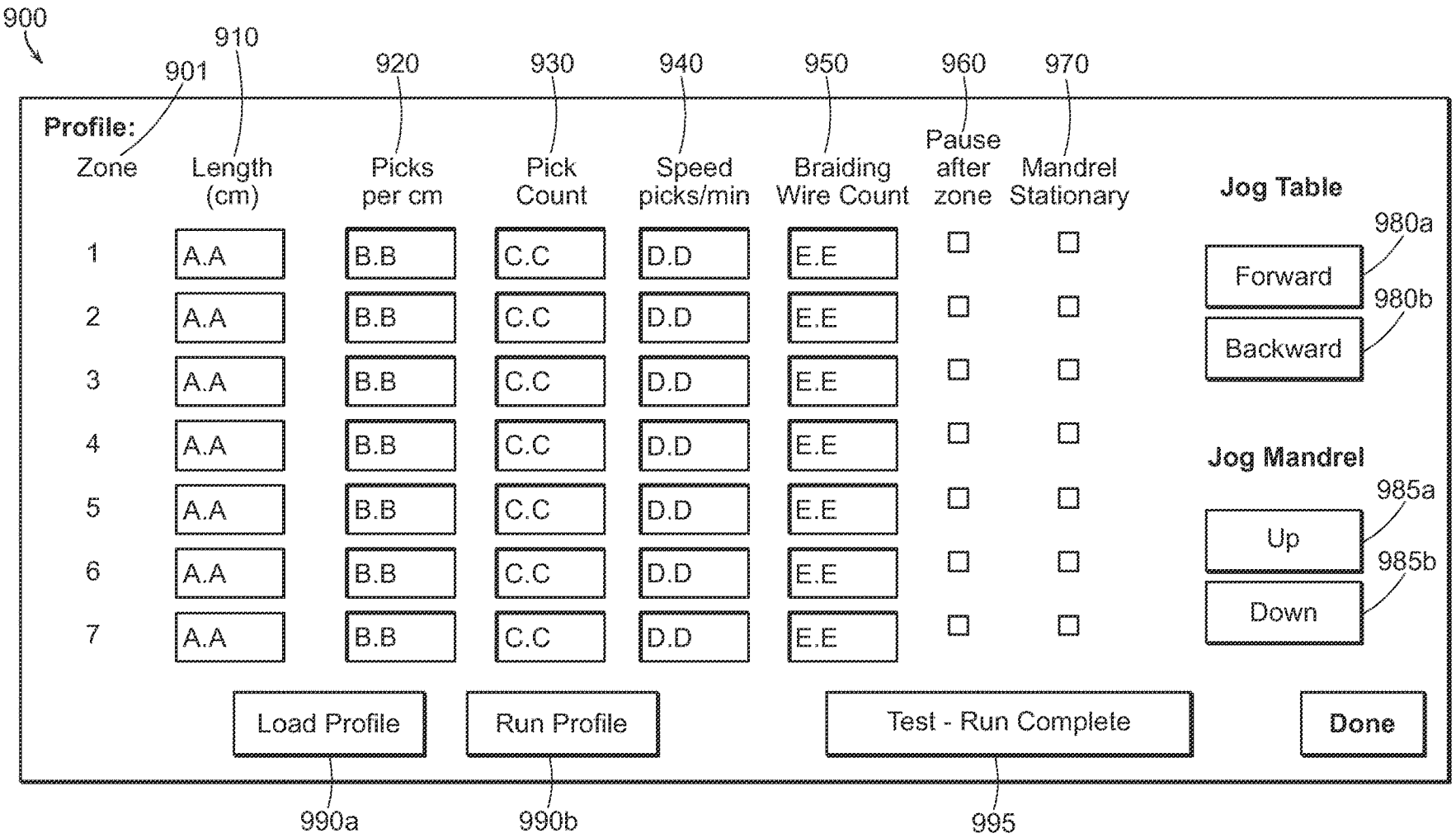
FIG. 9 is a display of user interface for a braiding system controller configured in accordance with embodiments of the present technology.

FIG. 9 is a screenshot of a user interface 900 that can be used to control the system 100 (FIG. 1) and the characteristics of the resulting braid 105 formed on the mandrel 102. A plurality of clickable, pushable, or otherwise engageable buttons, indicators, toggles, and/or user elements is shown within the user interface 900. For example, the user interface 900 can include a plurality of elements each indicating a desired and/or expected characteristic for the resulting braid 105. In some embodiments, characteristics can be selected for one or more zones 901 (e.g., the 7 illustrated zones) each corresponding to a different vertical portion of the braid 105 formed on the mandrel 102. More particularly, elements 910 can indicate a length for the zone along the length of the mandrel or braid (e.g., in cm), elements 920 can indicate a number of picks (a number of crosses) per cm, elements 930 can indicate a pick count (e.g., a total pick count), elements 940 can indicate a speed for the process (e.g., in picks formed per minute), and elements 950 can indicate a braiding wire count. In some embodiments, if the user inputs a specific characteristic for a zone 901, some or all of the other characteristics may be constrained or automatically selected. For example, a user input of a certain number of "picks per cm" and zone "length" may constrain or determine the possible number of "picks per cm." The user interface can further include selectable elements 960 for pausing of the system 100 after the braid 105 has been formed in a certain zone 901, and selectable elements 970 for keeping the mandrel stationary during the formation of a particular zone (e.g., to permit manual jogging of the mandrel 102 rather than automatic). In addition, the user interface can include elements 980*a* and 980*b* for jogging the table, elements 985*a* and 985*b* for jogging (e.g., raising or lowering) the mandrel 102 up or down, respectively, elements 990*a* and 990*b* for loading a profile (e.g., a set of saved braid characteristics) and running a selected profile, respectively, and an indicator 995 for indicating that a run (e.g., all or a portion of a braiding process) is complete.

Figure 10:
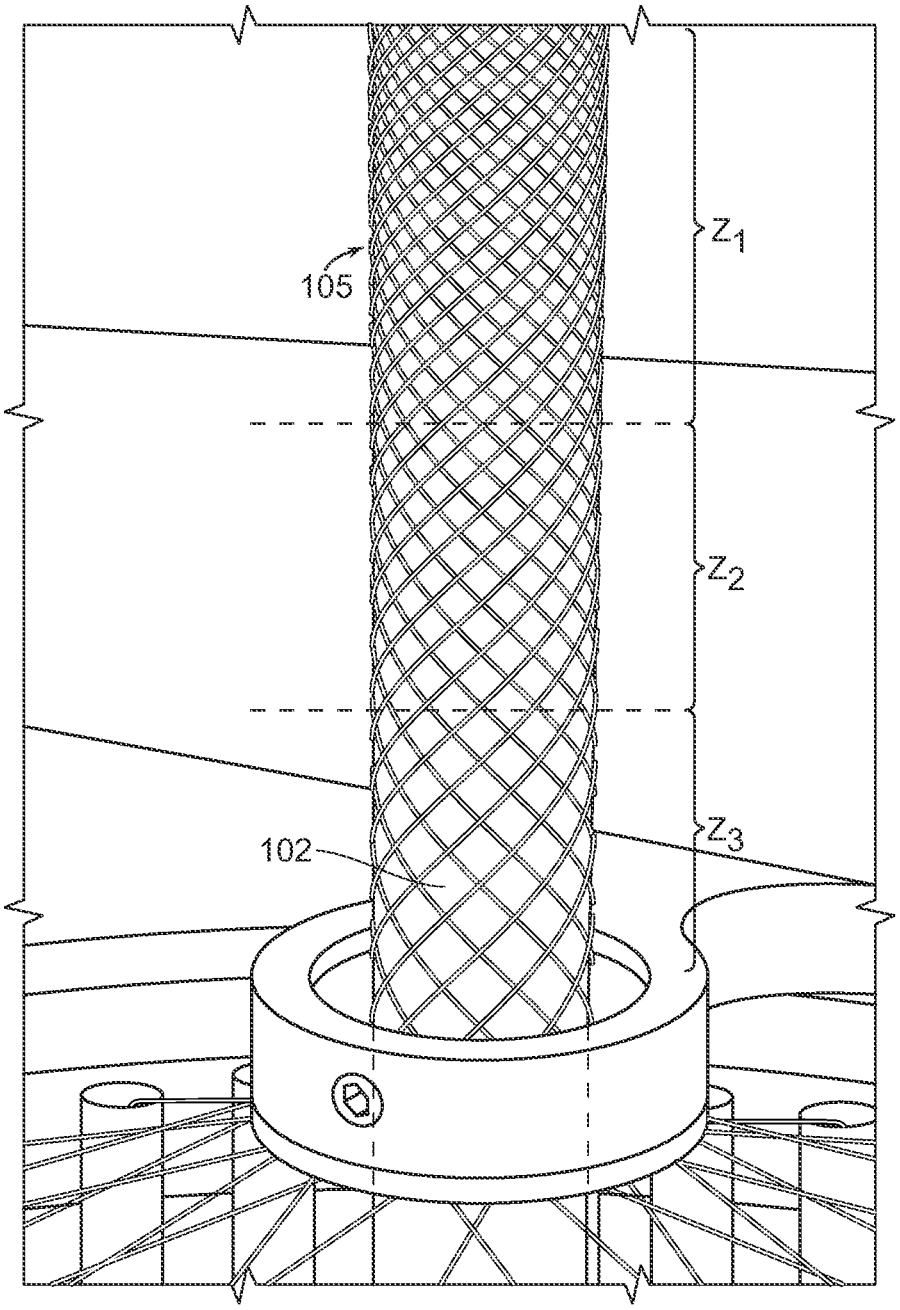
FIG. 10 is an isometric of a portion of a mandrel of the braiding system shown in FIG. 1 configured in accordance with embodiments of the present technology.

In some embodiments, for example, lower pick counts improve flexibility, while higher pick counts increases longitudinal stiffness of the braid 105. Thus, the system 100 advantageously permits for the pick count (and other characteristics of the braid 105) to be varied within a specific length of the braid 105 to provide variable flexibility and/or longitudinal stiffness. For example, FIG. 10 is an enlarged view of the mandrel 102 and the braid 105 formed thereon. The braid 105 or mandrel 102 can include a first zone Z1, a second zone Z2, and a third zone Z3 each having different characteristics. As shown, for example, the first zone Z1 can have a higher pick count than the second and third zones Z2 and Z3, and the second zone Z2 can have a higher pick count than third zone Z3. The braid 105 can therefore have a varying flexibility—as well as pore size—in each zone.

EXAMPLES

Several aspects of the present technology are set forth in the following examples.

1. A braiding system, comprising:
   an upper drive unit;
   a lower drive unit;
   a mandrel coaxial with the upper and lower drive units;
   a plurality of tubes extending between the upper drive unit and the lower drive unit, wherein individual tubes are configured to receive individual filaments, and wherein the upper drive unit and the lower drive unit act against the tubes in synchronization.
2. The braiding system of example 1 wherein the tubes are constrained within the upper and lower drive units, and wherein the upper and lower drive units act against the tubes to (i) drive the tubes radially inward, (ii) drive the tubes radially outward, and (iii) rotate the tubes with respect to the mandrel.
3. The braiding system of example 1 or 2 wherein the tubes include a first set of tubes and a second set of tubes, and wherein the upper and lower drive units act against the tubes to rotate the first set of tubes relative to the second set of tubes.
4. The braiding system of example 3 wherein the first and second set of tubes each include one half the total number of tubes.
5. The braiding system of any one of examples 1-4 wherein individual tubes include a lip portion proximate the upper drive unit, the lip portion having a rounded edge configured to slidably engage an individual filament.
6. The braiding system of any one of examples 1-5 wherein the upper and lower drive units are substantially identical.
7. The braiding system of claim of any one of examples 1-6 wherein—
   the upper drive unit comprises (a) an outer assembly including (i) outer slots, (ii) outer drive members, and (iii) an outer drive mechanism configured to move the outer drive members, and (b) an inner assembly including (i) inner slots, (ii) inner drive members, and (iii) an inner drive mechanism configured to move the inner drive members;
   the lower drive unit comprises (a) an outer assembly including (i) outer slots, (ii) outer drive members, and (iii) an outer drive mechanism configured to move the outer drive members, and (b) an inner assembly including (i) inner slots, (ii) inner drive members, and (iii) an inner drive mechanism configured to move the inner drive members; and individual tubes are constrained within individual ones of the inner and/or outer slots.
8. The braiding system of example 7 wherein—
   the outer slots of the upper drive unit are radially aligned with the outer drive members of the upper drive unit and the outer drive mechanism of the upper drive unit is configured to move the outer drive members radially inward through the outer slots;
   the inner slots of the upper drive unit are radially aligned with the inner drive members of the upper drive unit and the inner drive mechanism of the upper drive unit is configured to move the inner drive members radially outward through the inner slots;

the outer slots of the lower drive unit are radially aligned with the outer drive members of the lower drive unit and the outer drive mechanism of the lower drive unit is configured to move the outer drive members radially inward through the outer slots; and the inner slots of the lower drive unit are radially aligned with the inner drive members of the lower drive unit and the inner drive mechanism of the lower drive unit is configured to move the inner drive members radially outward through the inner slots.

9. The braiding system of example 7 or 8 wherein the number of outer slots of the upper and lower drive units is twice as great as the number of inner slots of the upper and lower drive units.

10. The braiding system of any one of examples 7-9 wherein— the outer assembly of the upper drive unit further comprises outer biasing members coupled to corresponding one of the outer drive members and configured to apply a radially outward force to the outer drive members;

the inner assembly of the upper drive unit further comprises inner biasing members coupled to corresponding one of the inner drive members and configured to apply a radially inward force to the inner drive members;

the outer assembly of the lower drive unit further comprises outer biasing members coupled to corresponding one of the outer drive members and configured to apply a radially outward force to the outer drive members; and the inner assembly of the lower drive unit further comprises inner biasing members coupled to corresponding one of the inner drive members and configured to apply a radially inward force to the inner drive members.

11. The braiding system of any one of examples 7-10 wherein— the inner assembly of the upper drive unit is rotatable relative to the outer assembly of the upper drive unit;

the inner assembly of the lower drive unit is rotatable relative to the outer assembly of the lower drive unit; and the inner assemblies of the lower and upper drive unit are configured to rotate in synchronization.

12. The braiding system of any one of examples 7-11 wherein— the outer drive mechanism of the upper drive unit comprises (i) a first upper outer cam ring configured to move a first set of the outer drive members of the upper drive unit radially inward and (ii) a second upper outer cam ring configured to move a second set of the outer drive members of the upper drive unit radially inward;

the inner drive mechanism of the upper drive unit comprises an upper inner cam ring configured to move the inner drive members of the upper drive unit radially outward;

the outer drive mechanism of the lower drive unit comprises (i) a first lower outer cam ring configured to move a first set of the outer drive members of the lower drive unit radially inward and (ii) a second lower outer cam ring configured to move a second set of the outer drive members of the lower drive unit radially inward; and the inner drive mechanism of the lower drive unit comprises a lower inner cam ring configured to move the inner drive members of the lower drive unit radially outward.

13. The braiding system of example 12 wherein— the first upper outer cam ring and the first lower outer cam ring are substantially identical and synchronized to move together;

the second upper outer cam ring and second lower outer cam ring are substantially identical and synchronized to move together; and the upper inner cam ring and the lower inner cam ring are substantially identical and synchronized to move together.

14. The braiding system of examples 12 or 13 wherein— the first set of the outer drive members of the upper drive unit comprises alternating ones of the outer drive members, and the second set of the outer drive members of the upper drive unit comprises different alternating ones of the outer drive members; and the first set of the outer drive members of the lower drive unit comprises alternating ones of the outer drive members, and the second set of the outer drive members of the lower drive unit comprises different alternating ones of the outer drive members.

15. The braiding system of any one of examples 12-14 wherein— the first upper outer cam ring is substantially identical to the second upper outer cam ring and rotatably coupled to the second upper outer cam ring; and the first lower outer cam ring is substantially identical to the second lower outer cam ring and rotatably coupled to the second lower outer cam ring.

16. The braiding system of any one of examples 12-15 wherein— the first upper outer cam ring has a radially-inward facing surface with a periodic shape that is in continuous contact with the first set of the outer drive members of the upper drive unit;

the second upper outer cam ring has a radially-inward facing surface with a periodic shape that is in continuous contact with the second set of the outer drive members of the upper drive unit;

the upper inner cam ring has a radially-outward facing surface with a periodic shape that is in continuous contact with the inner drive members of the upper drive unit;

the first lower outer cam ring has a radially-inward facing surface with a periodic shape that is in continuous contact with the first set of the outer drive members of the lower drive unit;

the second upper outer cam ring has a radially-inward facing surface with a periodic shape that is in continuous contact with the second set of the outer drive members of the lower drive unit; and the lower inner cam ring has a radially-outward facing surface with a periodic shape that is in continuous contact with the inner drive members of the lower drive unit.

17. The braiding system of any one of examples 7-16 wherein— the outer drive mechanism of the upper drive unit comprises an upper outer cam ring configured to move the outer drive members of the upper drive unit radially inward;

the inner drive mechanism of the upper drive unit comprises an upper inner cam ring configured to move the inner drive members of the upper drive unit radially outward;

the outer drive mechanism of the lower drive unit comprises a lower outer cam ring configured to move the outer drive members of the lower drive unit radially inward; and the inner drive mechanism of the lower drive unit comprises a lower inner cam ring configured to move the inner drive members of the lower drive unit radially outward.

18. The braiding system of example 17 wherein the upper outer cam ring and the lower outer cam ring are mechanically synchronized to move together, and wherein the upper inner cam ring and the lower inner cam ring are mechanically synchronized to move together.

19. A braiding system, comprising:

an outer assembly including (i) a central opening, (ii) a first outer cam, (iii) a second outer cam positioned adjacent to the first outer cam and coaxially aligned with the first outer cam along a longitudinal axis, (iv) outer slots extending radially relative to the longitudinal axis, and (v) an outer drive mechanism;

an inner assembly in the central opening of the outer assembly, the inner assembly including (i) an inner cam, (ii) inner slots extending radially relative to the longitudinal axis, (iii) and an inner drive mechanism; and a plurality of tubes constrained within the inner and/or outer slots, wherein the outer drive mechanism is configured to (i) rotate the first outer cam to drive a first set of the tubes radially inward from the outer slots to the inner slots and (ii) rotate the second outer cam to drive a second set of the tubes radially inward from the outer slots to the inner slots, and wherein the inner drive mechanism is configured to (i) rotate the inner cam to move either the first or second set of tubes radially outward from the inner slots to the outer slots and (ii) rotate the inner assembly relative to the outer assembly.

20. The system of example 19, further comprising:

a mandrel extending along the longitudinal axis; and a plurality of filaments, wherein each filament extends radially from the mandrel to an individual tube such that an end portion of the filament is within the individual tube.

21. The system of example 20 wherein the end portion of each filament is coupled to a weight.

22. The system of example 20 or 21 wherein the individual tube is a first individual tube, and wherein the filament further extends radially from the mandrel to a second individual tube such that a second end portion of the filament is within the second individual tube.

23. The system of any one of examples 20-22 wherein the filaments are braided about the mandrel when the tubes are driven through a series of radial and rotational movements by the outer and inner drive mechanisms.

24 The system of any one of examples 20-23 wherein the mandrel is configured to move along the longitudinal axis.

25. The system of any one of examples 20-24 wherein the first outer cam and the second outer cam are substantially identical and each have a radially-inward facing surface having a smooth sinusoidal shape.

26. The system of any one of examples 20-25 wherein the inner cam has a radially-outward facing surface having a saw-tooth shape.

27. A method of forming a tubular braid, comprising:

driving a first cam having a central axis to move a first set of tubes radially inward toward the central axis;

rotating the first set of tubes in a first direction about the central axis;

driving a second cam coaxially aligned with the first cam to move the first set of tubes radially outward away from the central axis;

driving a third cam coaxially aligned with first cam to move a second set of tubes radially inward toward the central axis;

rotating the second set of tubes in a second direction, opposite to the first direction, about the central axis; and driving the second cam to move the second set of tubes radially outward away from the central axis.

28. The method of example 27 wherein each tube in the first and second sets of tubes continuously engages a filament.

29. The method of example 28 wherein each of the filaments are in tension due to weight.

30 The method of example 28 or 29, further comprising:

constraining the first and second sets of tubes such that the tubes do not move in a direction parallel to the central axis; and moving a mandrel away from the tubes along the central axis, wherein the mandrel continuously engages each of the filaments.

31. The method of example 30, further comprising constraining the mandrel such that the mandrel does not substantially rotate about the central axis.

32 The method of any one of examples 27-31 wherein— driving the second cam to move the first set of tubes radially outward includes moving the first set of tubes to a radial position in which each tube in the first and second set of tubes is equally spaced radially from the central axis; and driving the second cam to move the second set of tubes radially outward includes moving the second set of tubes to the radial position.

33 The method of any one of examples 27-32 wherein— driving the first cam to move the first set of tubes radially inward includes engaging an inner surface of the first cam with first drive members that engage the first set of tubes;

driving the second cam to move the first set of tubes radially outward includes engaging an outer surface of the second cam with second drive members, the second drive members engaging the first set of tubes;

driving the third cam to move the second set of tubes radially inward includes engaging an inner surface of the third cam with third drive members that engage the second set of tubes; and driving the second cam to move the second set of tubes radially outward includes engaging the outer surface of the second cam with the second drive members, the second drive members engaging the second set of tubes.

34. The method of any one of examples 27-33, further comprising:

while driving the first cam to move the first set of tubes, driving the second cam to provide space for the first set of tubes to move radially inward;

while driving the second cam to move the first set of tubes, driving the first cam to provide space for the second set of tubes to move radially outward;

while driving the third cam to move the second set of tubes, driving the second cam to provide space for the second set of tubes to move radially inward; and while driving the second cam to move the second set of tubes, driving the third cam to provide space for the second set of tubes to move radially outward.

35. A method of forming a tubular braid, comprising:

engaging upper end portions of a first set of tubes of a plurality of tubes to drive the first set of tubes radially inward from an outer assembly to an inner assembly of an upper drive unit, while synchronously engaging lower end portions of the first set of tubes to drive the first set of tubes radially inward from an outer assembly to an inner assembly of a lower drive unit;

synchronously rotating the inner assemblies of the upper and lower drive units to rotate the first set of tubes in a first direction;

engaging the upper end portions of the first set of tubes to drive the first set of tubes radially outward from the inner assembly to the outer assembly of the upper drive unit, while synchronously engaging the lower end portions of the first set of tubes to drive the first set of tubes radially outward from the inner assembly to the outer assembly of the lower drive unit;

engaging upper end portions of a second set of tubes of the plurality of tubes to drive the second set of tubes radially inward from the outer assembly to the inner assembly of the upper drive unit, while synchronously engaging lower end portions of the second set of tubes to drive the second set of tubes radially inward from the outer assembly to the inner assembly of the lower drive unit;

synchronously rotating the inner assemblies of the upper and lower drive units to rotate the second set of tubes in a second direction opposite the first direction; and engaging the upper end portions of the second set of tubes to drive the second set of tubes radially outward from the inner assembly to the outer assembly of the upper drive unit, while synchronously engaging the lower end portions of the second set of tubes to drive the second set of tubes radially outward from the inner assembly to the outer assembly of the lower drive unit.

36 The method of example 35, further comprising, after driving the first set of tubes radially outward from the inner assemblies to the outer assemblies of the lower and upper drive units, synchronously rotating the inner assemblies in the second direction.

37. A braiding system, comprising:

an upper drive unit;

a lower drive unit;

a vertical mandrel coaxial with the upper and lower drive units;

a plurality of tubes extending between the upper drive unit and the lower drive unit, wherein individual tubes are configured to receive individual filaments, and wherein the tubes are constrained vertically within the upper and lower drive units; and wherein the upper drive unit and the lower drive unit act against the tubes in synchronization.

38 The braiding system of example 37, wherein— the upper drive unit comprises (a) an outer assembly including (i) outer slots, (ii) outer drive members, and (iii) an outer drive mechanism configured to move the outer drive members, and (b) an inner assembly including (i) inner slots, (ii) inner drive members, and (iii) an inner drive mechanism configured to move the inner drive members;

the lower drive unit comprises (a) an outer assembly including (i) outer slots, (ii) outer drive members, and (iii) an outer drive mechanism configured to move the outer drive members, and (b) an inner assembly including (i) inner slots, (ii) inner drive members, and (iii) an inner drive mechanism configured to move the inner drive members; and wherein individual tubes are constrained within individual ones of the inner and outer slots.

39 The braiding system of example 38, wherein— the outer drive mechanism of the upper drive unit comprises an upper outer cam ring configured to move the outer drive members of the upper drive unit radially inward;

the inner drive mechanism of the upper drive unit comprises an upper inner cam ring configured to move the inner drive members of the upper drive unit radially outward;

the outer drive mechanism of the lower drive unit comprises a lower outer cam ring configured to move the outer drive members of the lower drive unit radially inward; and the inner drive mechanism of the lower drive unit comprises a lower inner cam ring configured to move the inner drive members of the lower drive unit radially outward.

40. The braiding system of example 39, wherein the upper outer cam ring and the lower outer cam ring are mechanically synchronized to move together, and wherein the upper inner cam ring and the lower inner cam ring are mechanically synchronized to move together.

41. A mechanism for braiding, comprising:

a first disc cam with a central opening and defining a plane;

a second disc cam with a central opening and defining a plane that can be rotated relative to the first disc cam;

an inner slotted disc with a plurality of slots in a circular array;

an outer slotted disc with a plurality of slots in a circular array;

a mandrel extending concentrically with respect to the first and second disc cams and generally perpendicular to the planes of the first and second disc cams and defining an axis;

a plurality of tubes, each tube having an upper end and a lower end, and the upper ends of the tubes are arrayed in a circle about the mandrel;

a drive mechanism that rotates at least one of the disc cams thus moving a half of the tubes in the radial direction into or out of the slots of the inner or outer disc;

a drive mechanism that rotates at least one slotted disc to move half of the tubes relative to the other half of the tubes;

a plurality of filaments, each filament having a first end and second end, the first end of each filament extending from the mandrel in a radial direction and then individually within a tube, wherein the filaments are braided about the mandrel when the tubes are moved through a series of radial and rotational movements driven by movement of the discs.

42. The mechanism of example 41 wherein the tubes are driven by upper and lower drive mechanisms mechanically linked for synchronized movement of the tubes.

43. The mechanism of example 41 or 42, further comprising a weight at the second end of each filament.

44. The mechanism of any one of examples 41-43, wherein the outer and inner slotted discs define a plurality of radial spaces, and individual radial spaces are configured to constrain an individual tube of the plurality of tubes, and wherein synchronized movement of the outer and inner slotted discs move the tubes in an over-under weave.

45 The mechanism of claim 44, wherein at least one of the outer disc cam and the inner disc cam moves relative to the other, and wherein each tube is constrained in a radial space while the one of the outer disc cam and inner disc cam moves.

46. A method of forming a tubular braid of filaments, comprising;

providing a braiding mechanism comprising a plurality of filaments, a plurality of tubes equal to the number of filaments where each tube continuously engages a filament, a mandrel, a plurality of discs configured to move the tubes and at least one drive mechanism configured to move the discs thus driving movement of the tubes and filaments to form a braid about the mandrel comprising the following steps:

(a) moving a first set of tubes to the inner disc;

(b) rotating the inner disc in a first direction;

(c) moving the first set of tubes to the outer disc;

(d) moving a second set of tubes to the inner disc;

(e) rotating the inner disc in the reverse direction;

(f) moving the second set of tubes back to the outer disc;

(g) moving the second set of tubes back to the outer disc; and (h) rotating the inner disc back to the initial position.

47. The method of example 46, wherein the first and second set of filaments are each one half of the total filaments.

48. The method of example 46 or 47, wherein movement of the tubes are by upper and lower drive mechanisms mechanically linked for synchronized movement of the tubes 49. The method of any one of examples 46-48, wherein each of the filaments are in tension due to weight.

CONCLUSION

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

I claim:

1. A braiding system, comprising:

a plurality of elongate members each configured to receive a corresponding one of a plurality of filaments;

a plate assembly including a plurality of slots positioned circumferentially about a longitudinal axis, wherein each of the slots is configured to receive a corresponding one of the elongate members;

a cam extending circumferentially about the longitudinal axis; and a drive mechanism configured to rotate the cam about the longitudinal axis to drive at least a set of the elongate members radially through the slots relative to the longitudinal axis.

2. The braiding system of claim 1 wherein the cam has an inner surface and an outer surface, wherein the outer surface is farther from the longitudinal axis than the inner surface, and wherein the inner surface has a periodic shape.

3. The braiding system of claim 1 wherein the cam has an inner surface and an outer surface, wherein the outer surface is farther from the longitudinal axis than the inner surface, and wherein the outer surface has a periodic shape.

4. The braiding system of claim 1, further comprising a plurality of drive members, wherein individual ones of the drive members are aligned with corresponding ones of the slots, wherein the cam is configured to contact the drive members, and wherein the drive mechanism is configured to rotate the cam to move the drive members to drive the at least set of the elongate members radially through the slots relative to the longitudinal axis.

5. The braiding system of claim 4 wherein the drive mechanism is configured to rotate the cam to a first position to move a first set of the drive members radially in a first direction relative to the longitudinal axis while permitting a second set of the drive members to move radially in a second direction relative to the longitudinal axis, and wherein the first direction is opposite to the second direction.

6. The braiding system of claim 5 wherein the drive mechanism is configured to rotate the cam from the first position to a second position to move the second set of the drive members radially in the first direction relative to the longitudinal axis while permitting the first set of the drive members to move radially in the second direction relative to the longitudinal axis.

7. The braiding system of claim 6 wherein the first and second sets of the drive members include a same number of drive members.

8. The braiding system of claim 1 wherein the cam is a first cam, wherein the drive mechanism is configured to rotate the first cam about the longitudinal axis to drive the at least set of the elongate members radially inward through the slots toward the longitudinal axis, and further comprising a second cam extending circumferentially about the longitudinal axis, wherein the drive mechanism is configured to rotate the second cam about the longitudinal axis to drive the at least set of the elongate members radially outward through the slots away from the longitudinal axis.

9. The braiding system of claim 1, further comprising a plurality of weights configured to be secured to corresponding ones of the filaments to tension the filaments.

10. The braiding system of claim 9 wherein the filaments and the weights are configured to move within the elongate members.

11. The braiding system of claim 9 wherein the elongate members are hollow tubes.

12. The braiding system of claim 1, further comprising a mandrel positioned along the longitudinal axis.

13. The braiding system of claim 1 wherein the plate assembly is at least partially rotatable to rotate the slots about the longitudinal axis.

14. A braiding system, comprising:

a plurality of elongate members each having an upper portion and a lower portion, wherein individual ones of the elongate members are configured to receive individual filaments;

an upper drive unit including (a) a first upper cam configured to act against the upper portions of the elongate members to drive the upper portions of the elongate members radially inward toward a longitudinal axis and (b) a second upper cam configured to act against the upper portions of the elongate members to drive the upper portions of the elongate members radially outward away from the longitudinal axis; and a lower drive unit coaxially aligned with the upper drive unit along the longitudinal axis, wherein the upper drive unit includes (a) a first lower cam configured to operate in synchrony with the first upper cam and act against the lower portions of the elongate members to drive the lower portions of the elongate members radially inward toward the longitudinal axis as the first upper cam drives the upper portions of the elongate members radially inward and (b) a second lower cam configured to operate in synchrony with the second upper cam and act against the lower portions of the elongate members to drive the lower portions of the elongate members radially outward away from the longitudinal axis as the second upper cam drives the upper portions of the elongate members radially outward.

15. The braiding system of claim 14 wherein the upper drive unit constrains the upper portions of the elongate members, and wherein the lower drive unit constrains the lower portions of the elongate members.

16. The braiding system of claim 14 wherein the upper and lower drive units are further configured to move the elongate members along an arcuate path with respect to the longitudinal axis.

17. The braiding system of claim 14 wherein the upper and lower drive units are substantially identical.

18. The braiding system of claim 14 wherein the first upper cam is mechanically synchronized to move together with the first lower cam.

19. The braiding system of claim 18 wherein the second upper cam is mechanically synchronized to move together with the second lower cam.

20. The braiding system of claim 14 wherein— the upper drive unit includes (a) an outer assembly having outer slots and (b) an inner assembly having inner slots;

the lower drive unit includes (a) an outer assembly having outer slots and (b) an inner assembly having inner slots; and individual ones of the elongate members are constrained within individual ones of the inner and/or outer slots of the upper and lower drive units.

* * * * *